US012535261B2

(12) United States Patent
Lee

(10) Patent No.: US 12,535,261 B2
(45) Date of Patent: Jan. 27, 2026

(54) REFRIGERATOR

(71) Applicant: LG ELECTRONICS INC., Seoul (KR)

(72) Inventor: Sung Hun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/289,209

(22) PCT Filed: May 10, 2022

(86) PCT No.: PCT/KR2022/006630
§ 371 (c)(1),
(2) Date: Nov. 1, 2023

(87) PCT Pub. No.: WO2023/286990
PCT Pub. Date: Jan. 19, 2023

(65) Prior Publication Data

US 2024/0219103 A1 Jul. 4, 2024

(30) Foreign Application Priority Data

Jul. 15, 2021 (KR) ..... 10-2021-0092997

(51) Int. Cl.
*F25D 23/02* (2006.01)
*F25D 21/04* (2006.01)

(52) U.S. Cl.
CPC ..... *F25D 23/028* (2013.01); *F25D 21/04* (2013.01); *F25D 2323/021* (2013.01); *F25D 2400/18* (2013.01)

(58) Field of Classification Search
None
See application file for complete search history.

(56) References Cited

U.S. PATENT DOCUMENTS 4,998,382 A * 3/1991 Kostos ..... E06B 3/6617 49/504
5,910,083 A * 6/1999 Richardson ..... A47F 3/0434 52/656.1

(Continued)

FOREIGN PATENT DOCUMENTS

CN 106247746 A 12/2016
CN 106247746 B 11/2019

(Continued)

OTHER PUBLICATIONS

International Search Report and Written Opinion in International Appln. No. PCT/KR2022/006630, mailed on Aug. 8, 2022, 3 pages.

(Continued)

*Primary Examiner* — Hanh V Tran
(74) *Attorney, Agent, or Firm* — Fish & Richardson P.C.

(57) ABSTRACT

A refrigerator is proposed. The refrigerator may include a cabinet (10) in which a storage compartment is formed, and a door (100) configured to open and close the storage compartment. The door (100) may include a panel assembly (110) having a front panel (111) constituting the front surface of the door (100) and a rear panel (115) laminated on the rear of the front panel (111), the front panel and the rear panel being connected to each other. The door (100) may include a side frame (A) constituting each of the opposite side surfaces of the door (100), an upper frame (B) constituting the upper surface of the door (100), and a lower frame (C) constituting the lower surface of the door (100).

19 Claims, 14 Drawing Sheets

(56) References Cited

U.S. PATENT DOCUMENTS

| | | | | |
|---|---|---|---|---|
| 10,119,751 | B2 * | 11/2018 | Choi | F21V 19/003 |
| 10,342,363 | B2 * | 7/2019 | Park | A47F 3/0434 |
| 10,436,504 | B2 * | 10/2019 | Lee | F25D 23/028 |
| 10,619,909 | B2 * | 4/2020 | Lee | F25D 29/005 |
| 10,808,994 | B2 * | 10/2020 | Lee | F21V 33/0044 |
| 11,047,613 | B1 | 6/2021 | Park et al. | |
| 11,624,549 | B2 * | 4/2023 | Kim | F25D 23/04 312/405 |
| 11,885,553 | B2 * | 1/2024 | Bae | F25D 23/028 |
| 11,885,556 | B2 * | 1/2024 | Kang | F25D 27/005 |
| 11,988,442 | B2 * | 5/2024 | Kwon | F25D 23/066 |
| 12,000,644 | B2 * | 6/2024 | Jin | A47F 3/0434 |
| 2011/0089790 | A1 | 4/2011 | Lee et al. | |
| 2021/0140702 | A1 * | 5/2021 | Park | E05F 15/619 |

FOREIGN PATENT DOCUMENTS

| | | | | | |
|---|---|---|---|---|---|
| EP | 3378359 | A1 * | 9/2018 | | A47F 3/0434 |
| EP | 3617625 | A1 * | 3/2020 | | E05F 15/73 |
| EP | 3809073 | A1 | 4/2021 | | |
| IT | 1102712 | B * | 10/1985 | | A47F 3/043 |
| JP | 2004232887 | A | 8/2004 | | |
| KR | 20140097799 | A | 8/2014 | | |
| KR | 20190135396 | A * | 12/2019 | | |
| KR | 20190137517 | A * | 12/2019 | | |
| KR | 20210058235 | A * | 5/2021 | | |
| WO | WO-2020050520 | A1 * | 3/2020 | | A47F 3/043 |
| WO | WO-2020096258 | A1 * | 5/2020 | | D06F 39/14 |
| WO | WO 2021/112658 | A1 | 6/2021 | | |

OTHER PUBLICATIONS

Extended European Search Report in European Appln. No. 22842253.1, mailed on Mar. 28, 2025, 9 pages.

* cited by examiner

[Fig. 1]
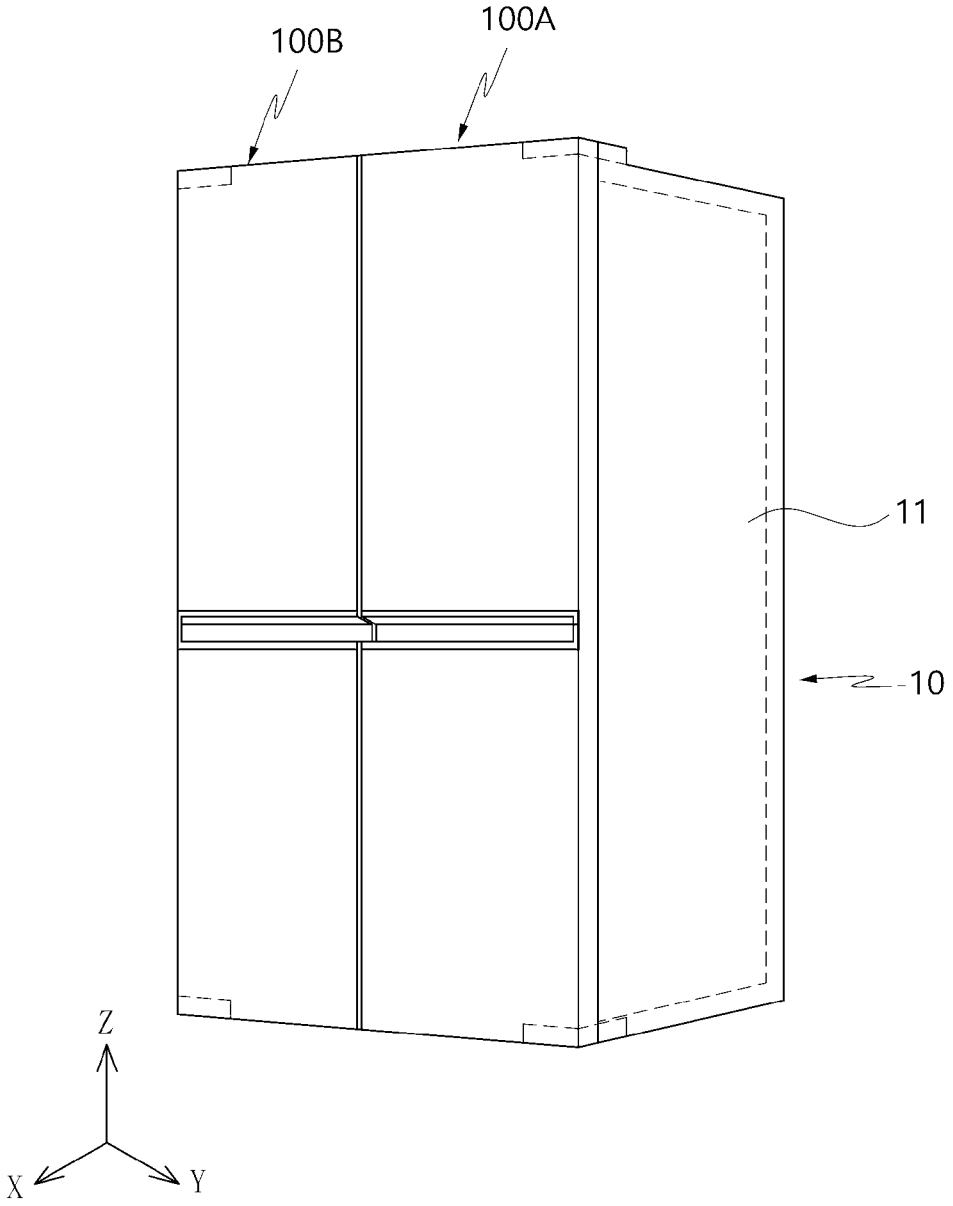

[Fig. 2]
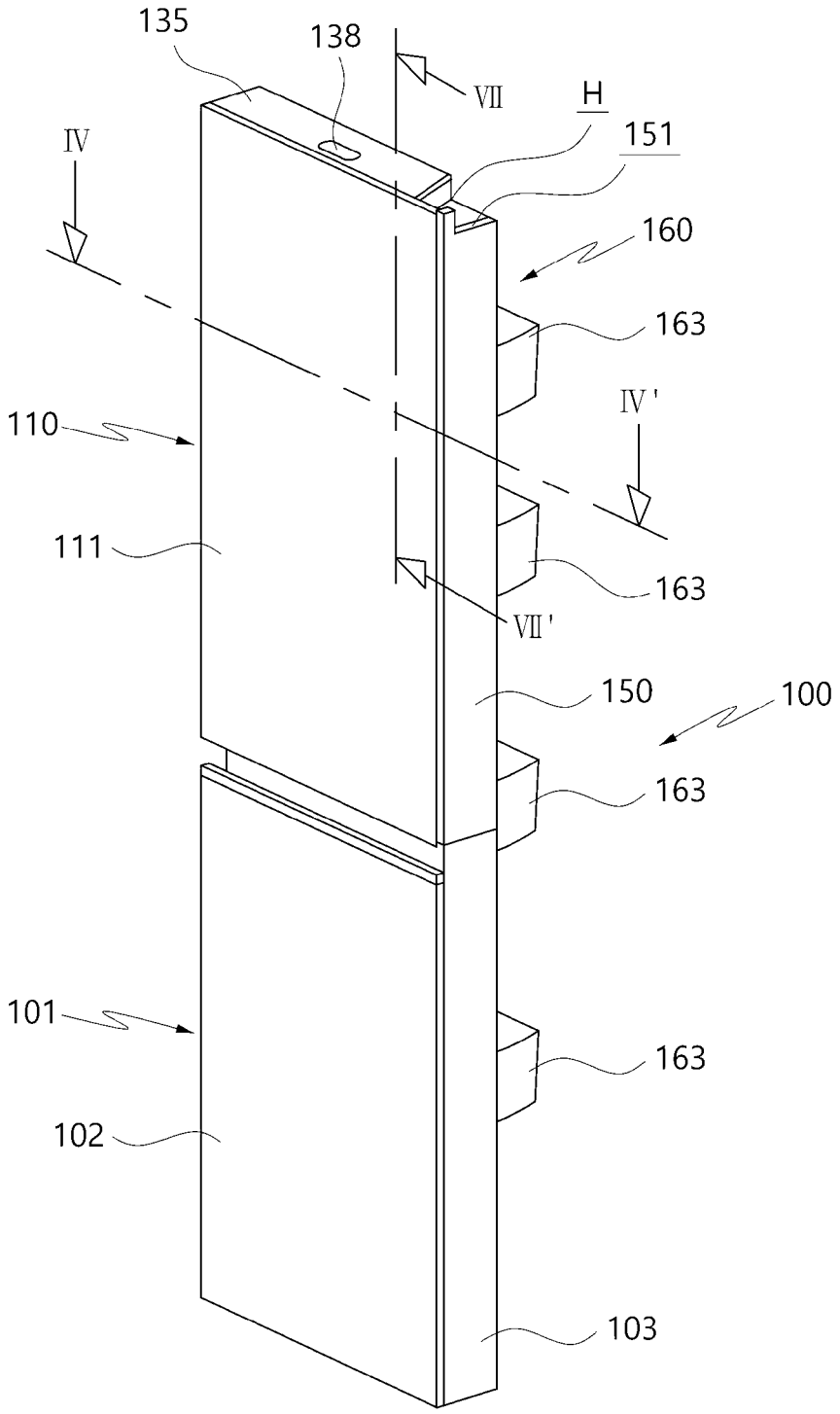

[Fig. 3]
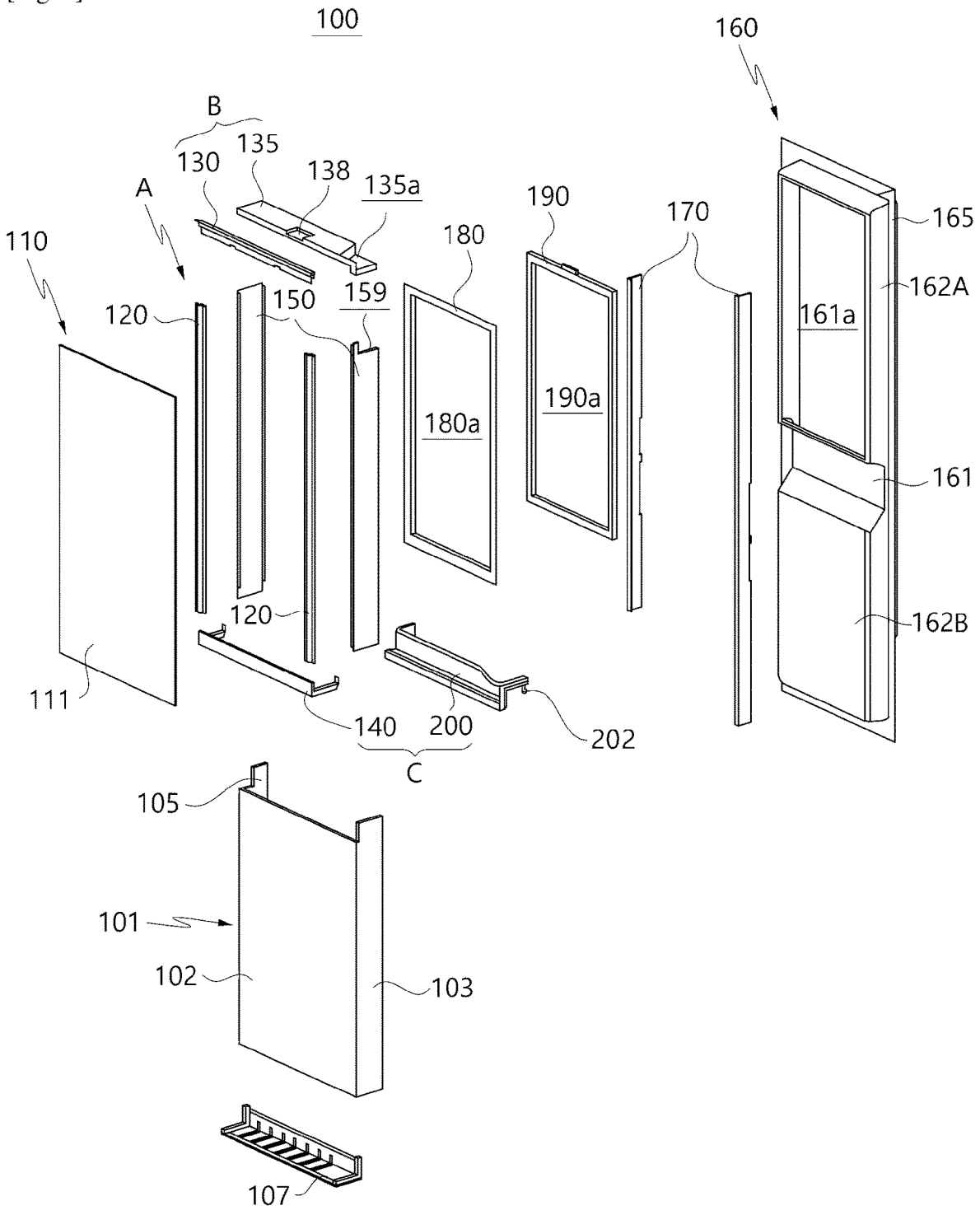

[Fig. 4]
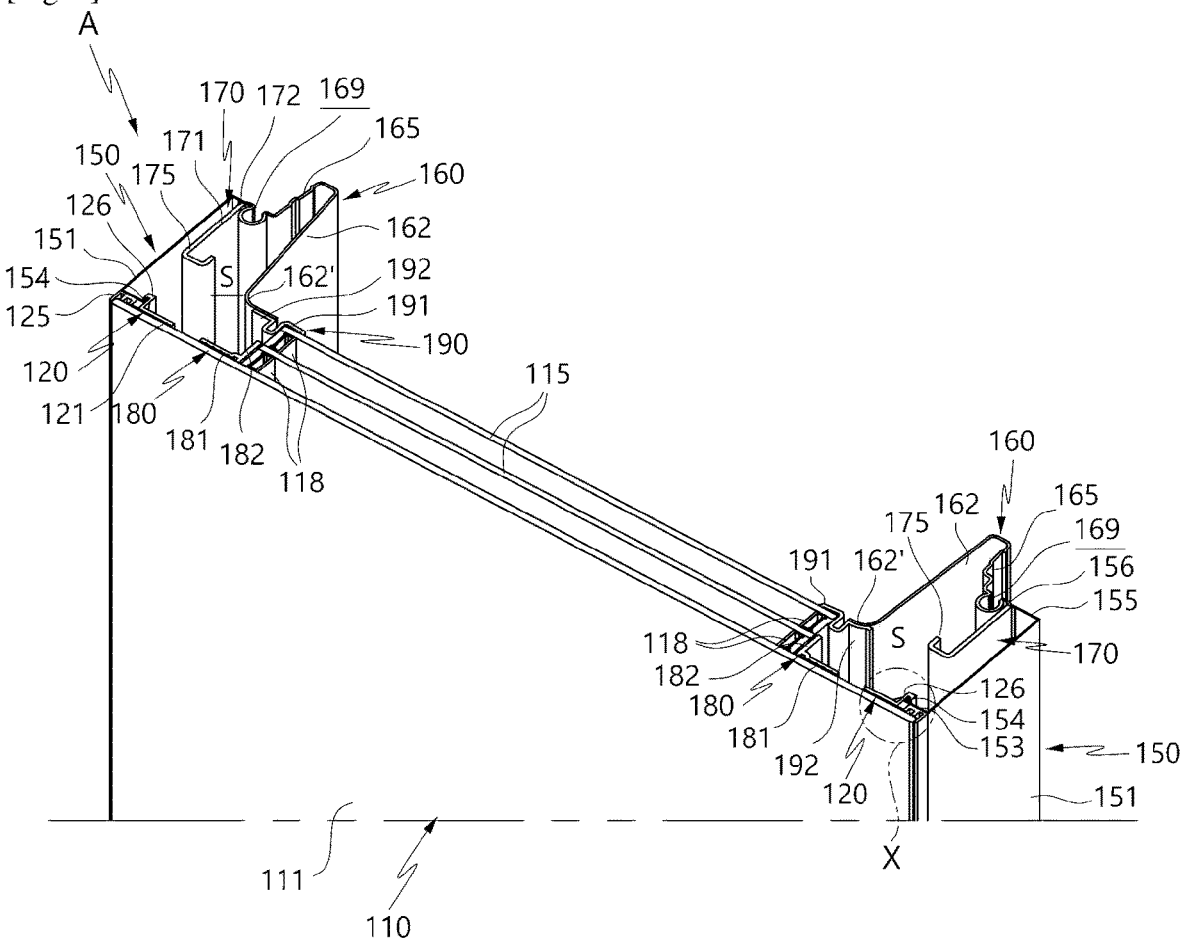
[Fig. 5]
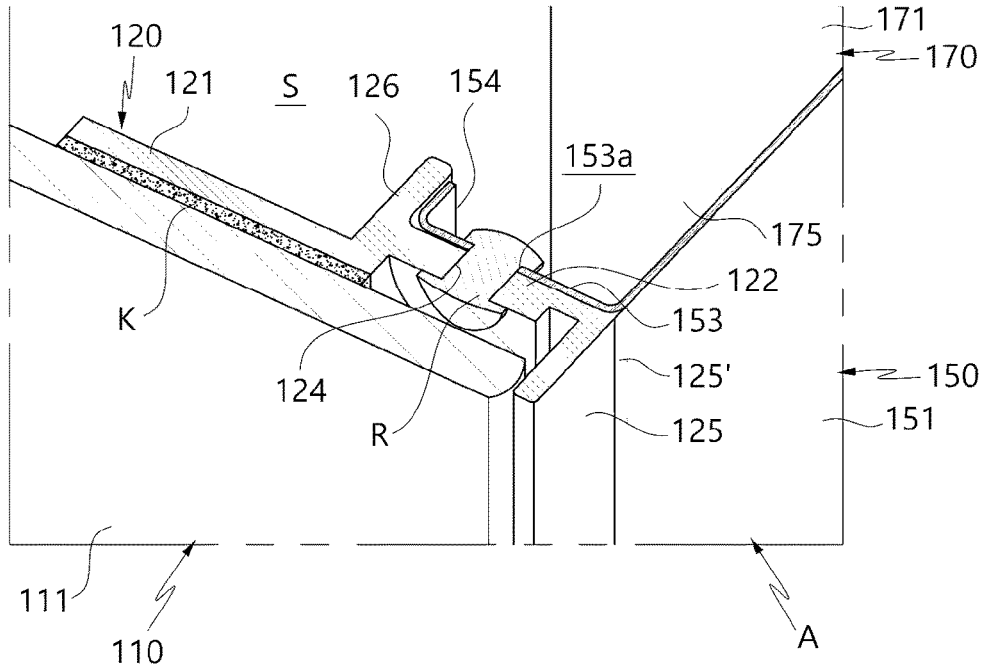

[Fig. 6]
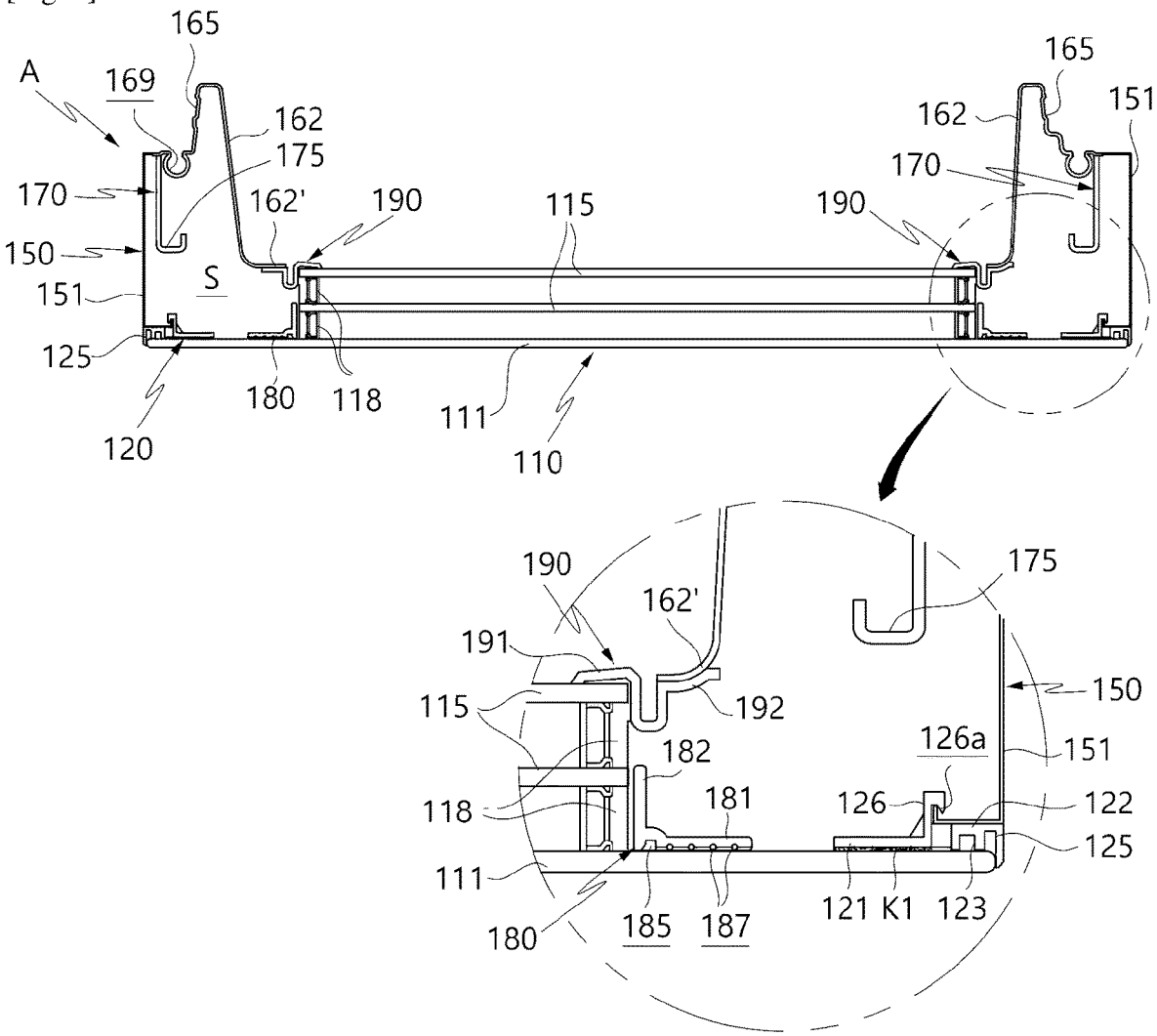

[Fig. 7]
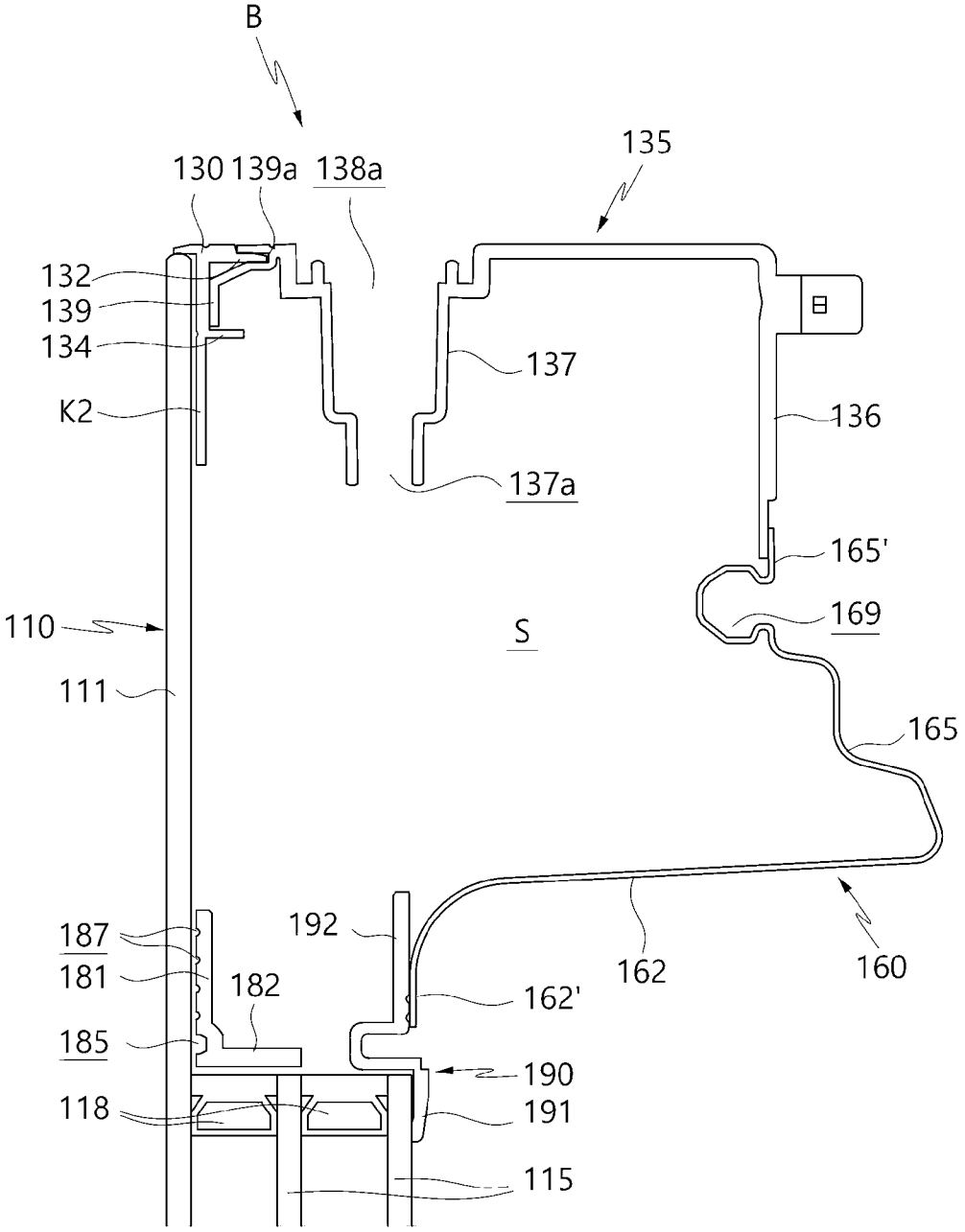

[Fig. 8]
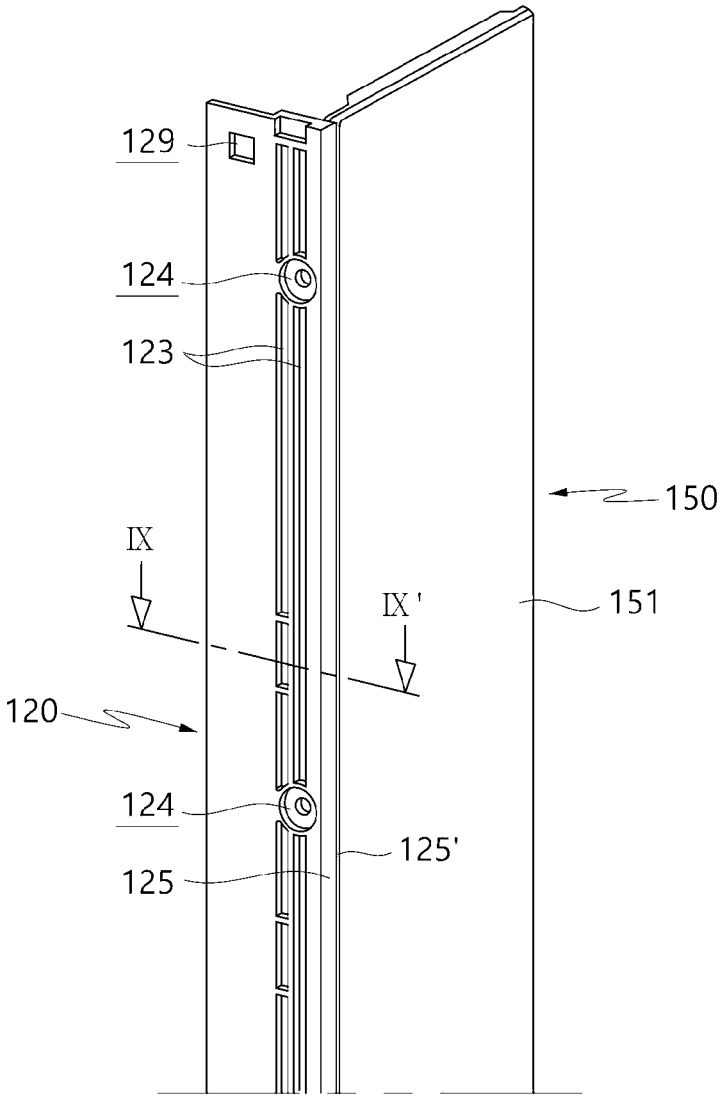

[Fig. 9]
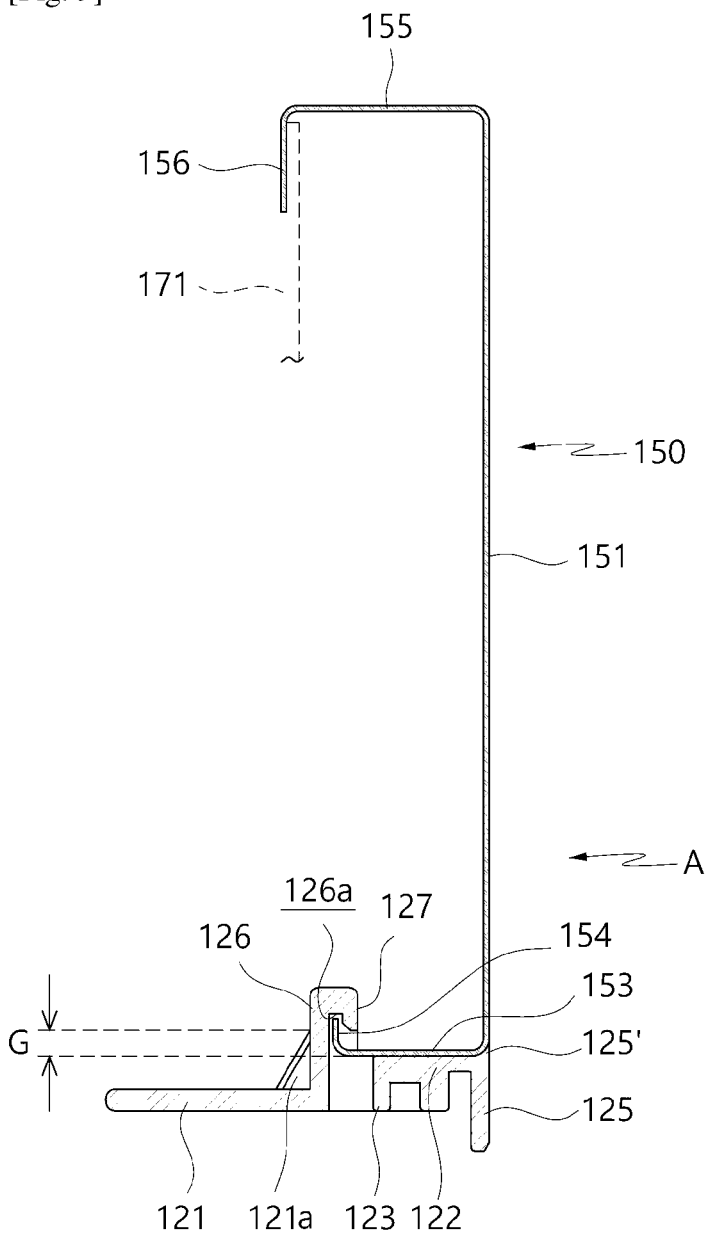

[Fig. 10]
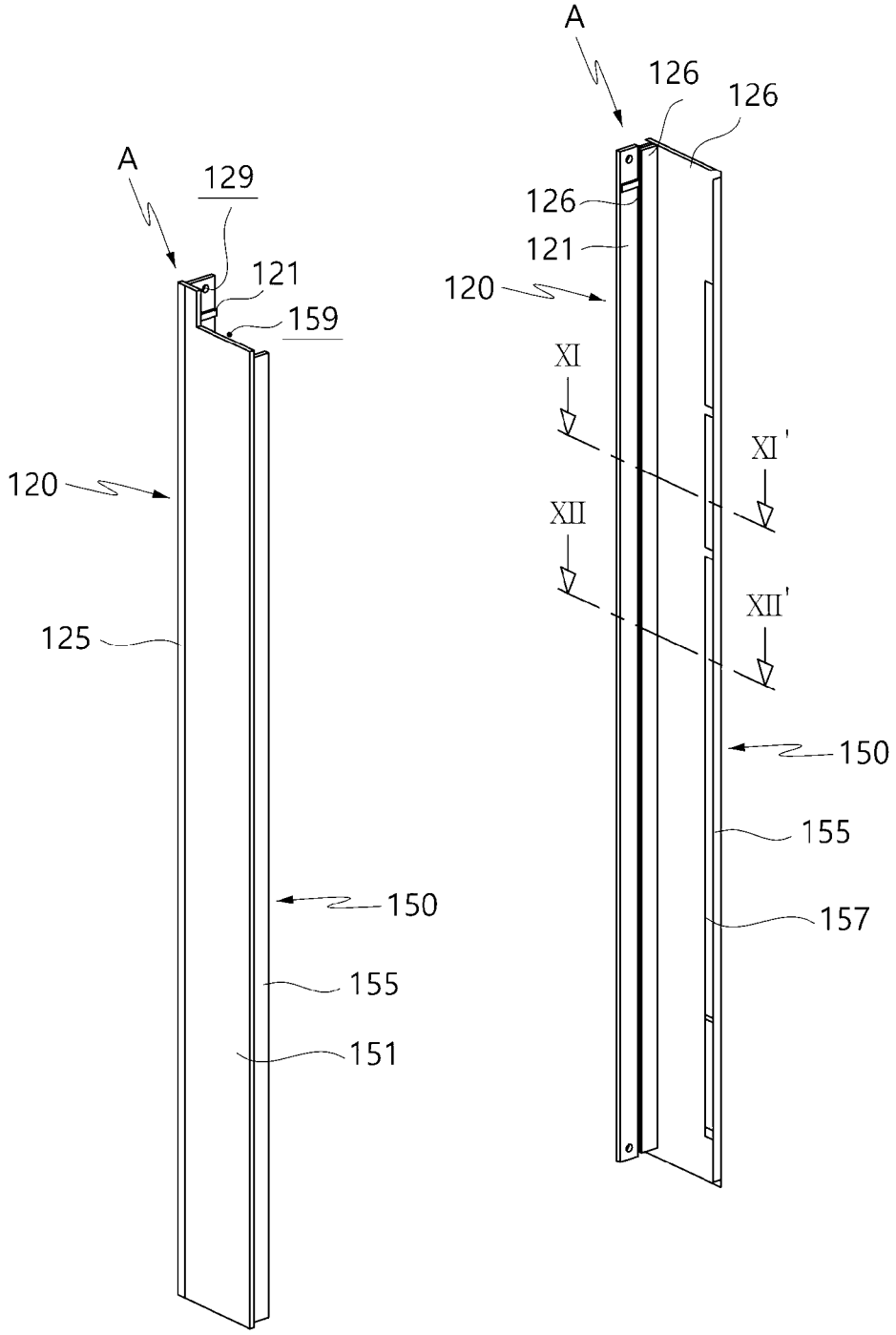

[Fig. 11]
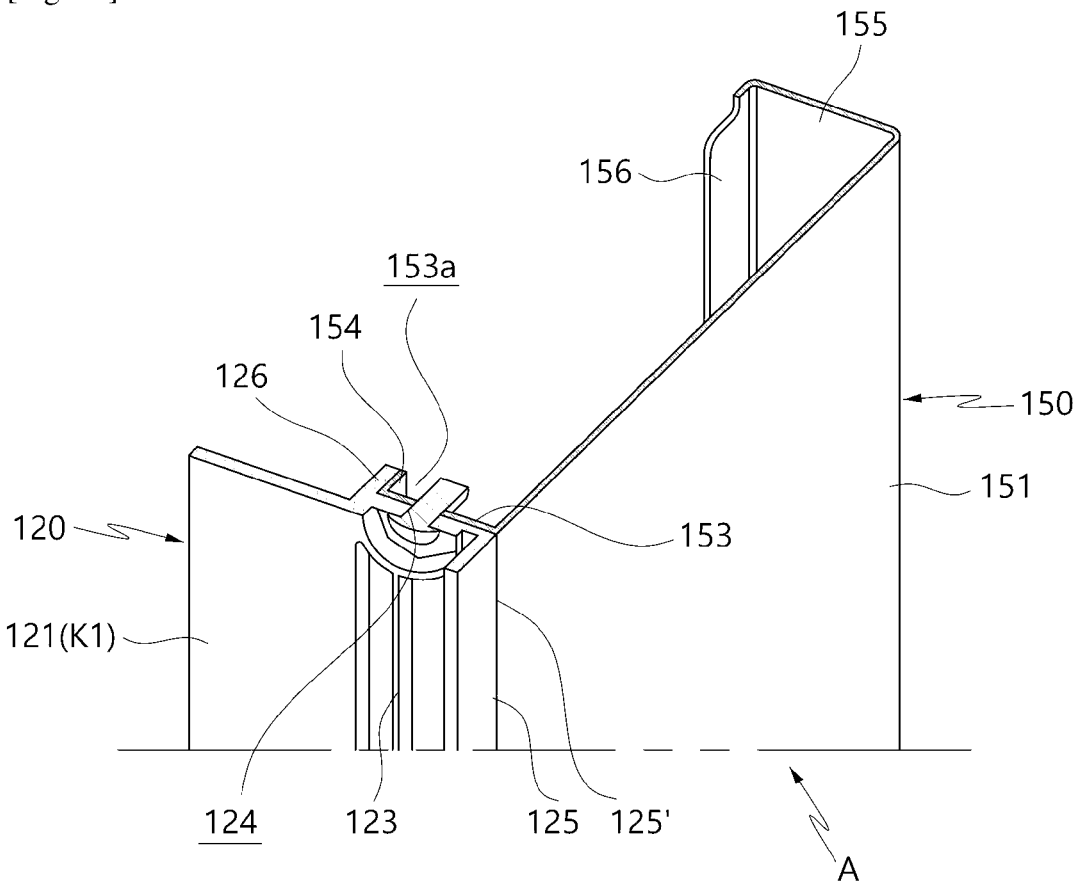
[Fig. 12]
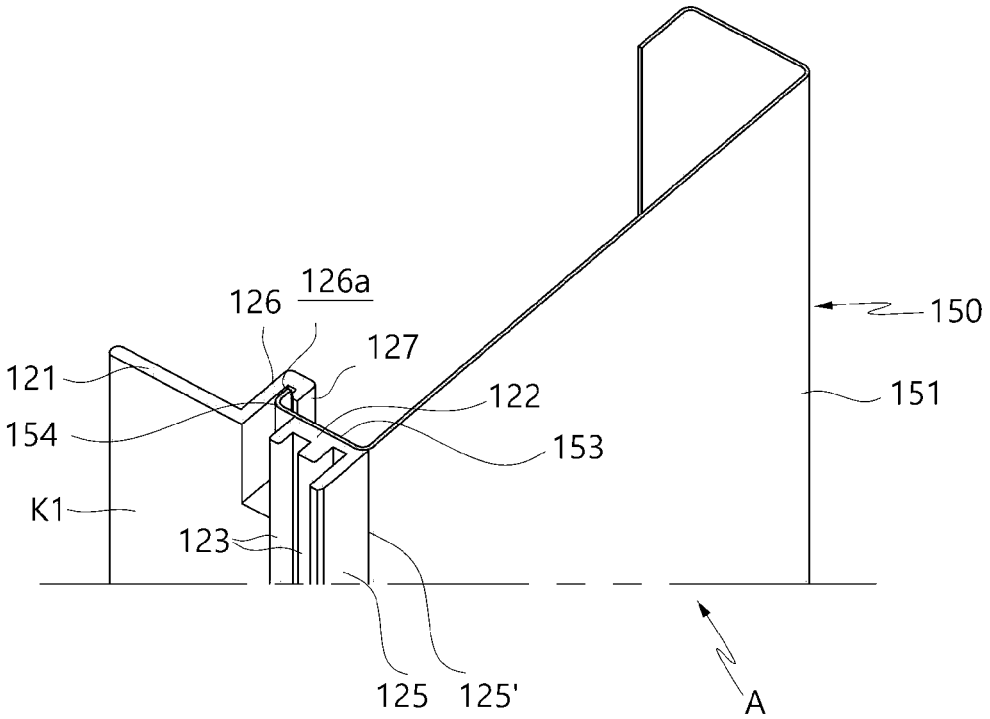

[Fig. 13]
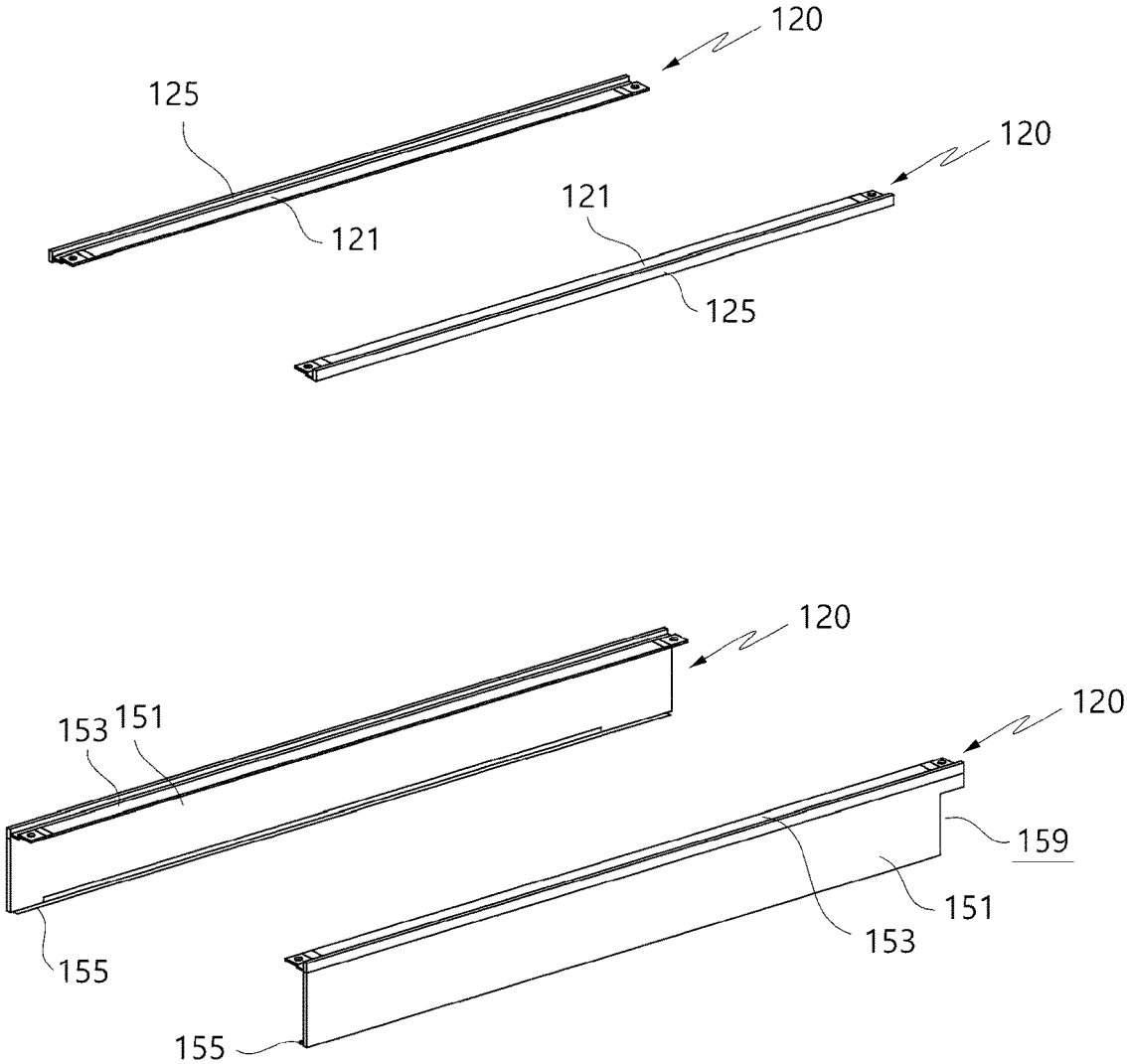
[Fig. 14]
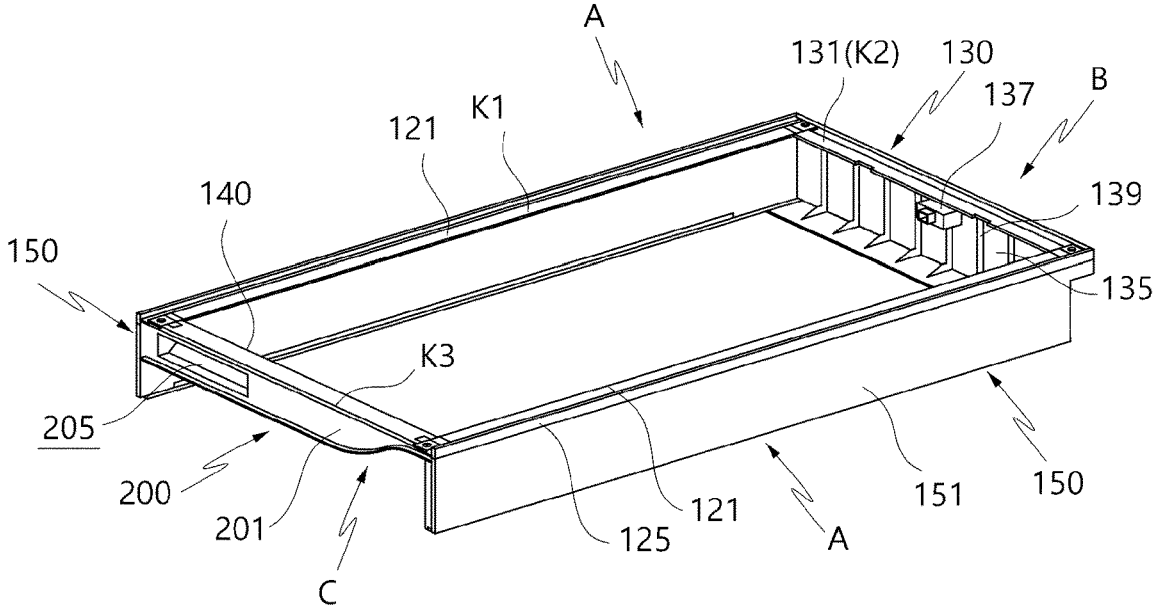

[Fig. 15]
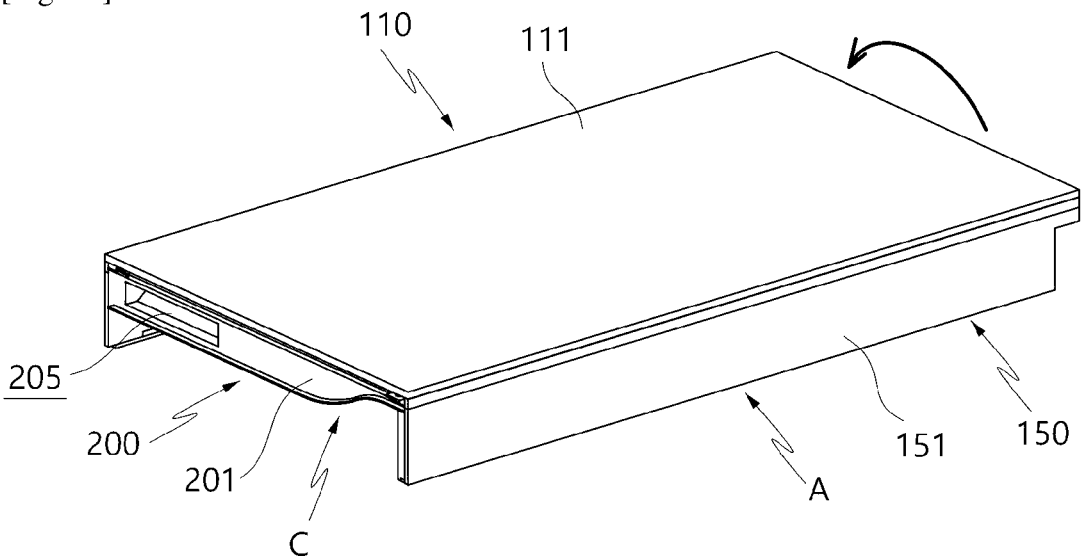
[Fig. 16]
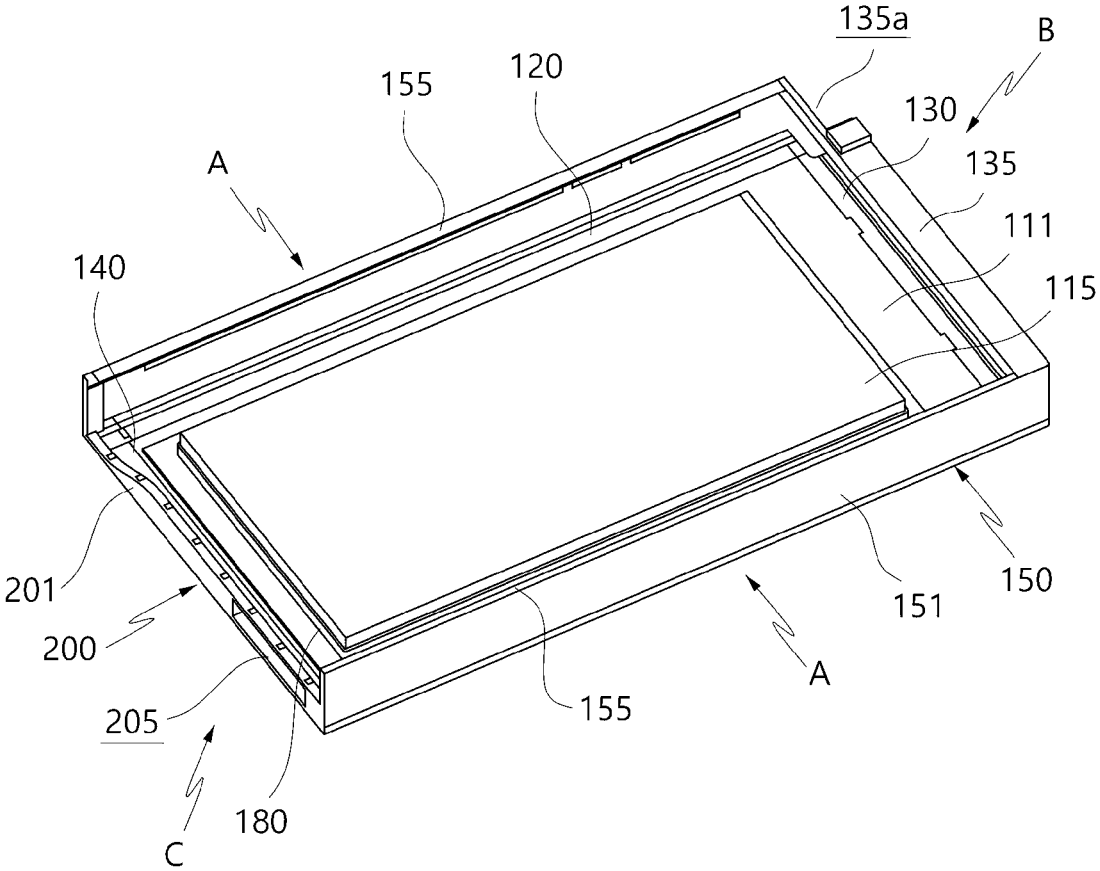

[Fig. 17]
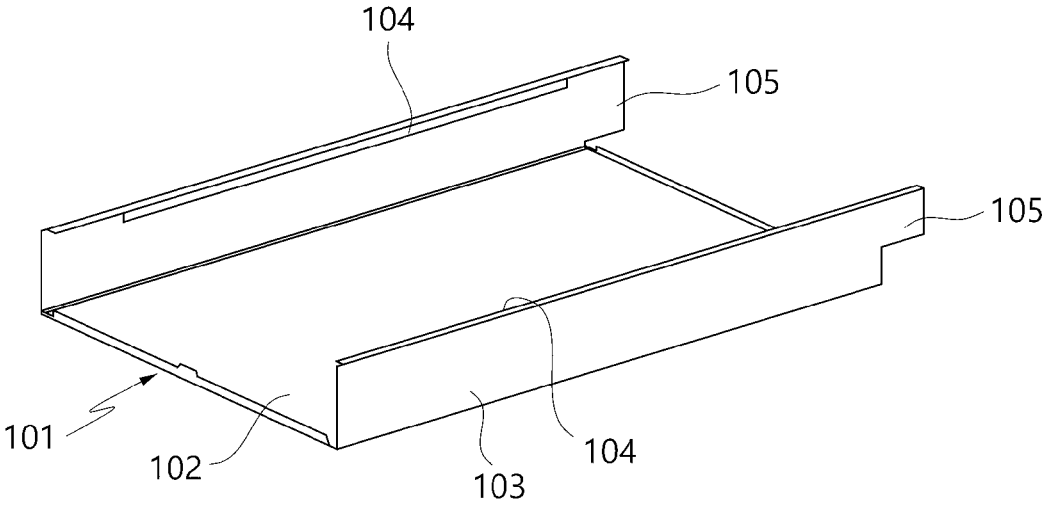
[Fig. 18]
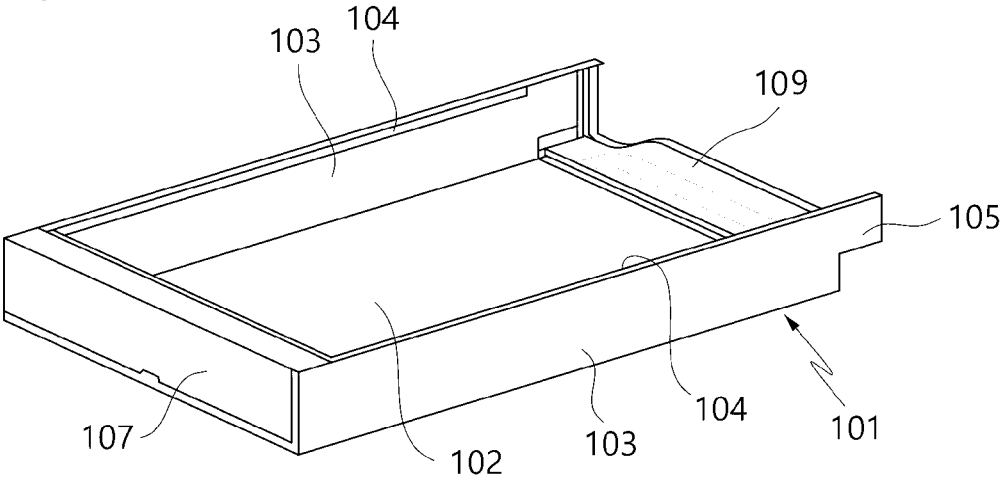
[Fig. 19]
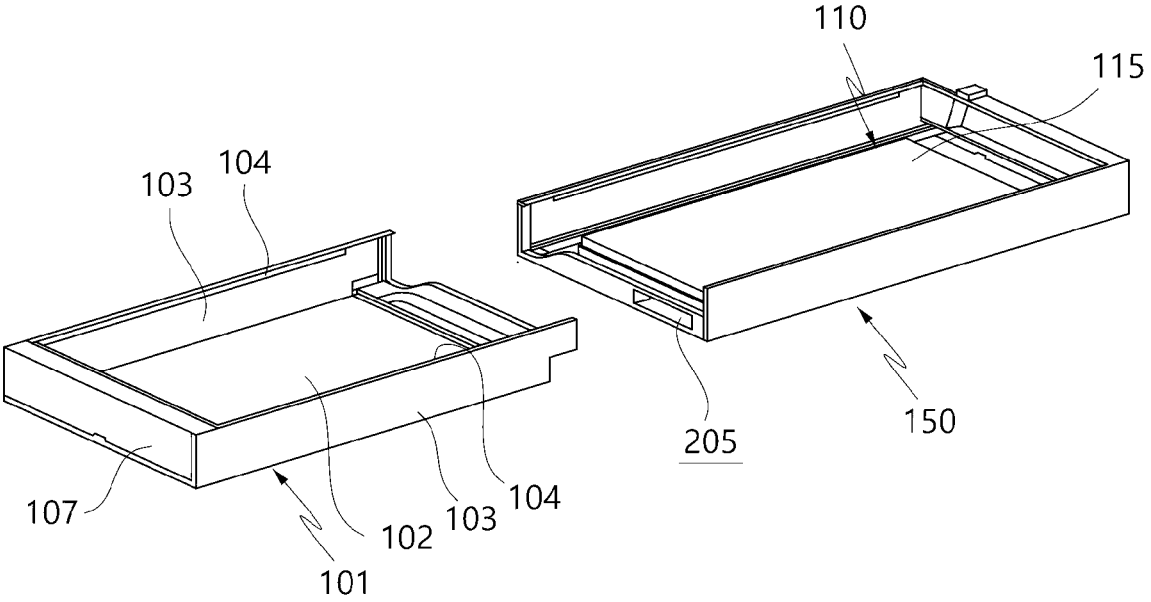

[Fig. 20]
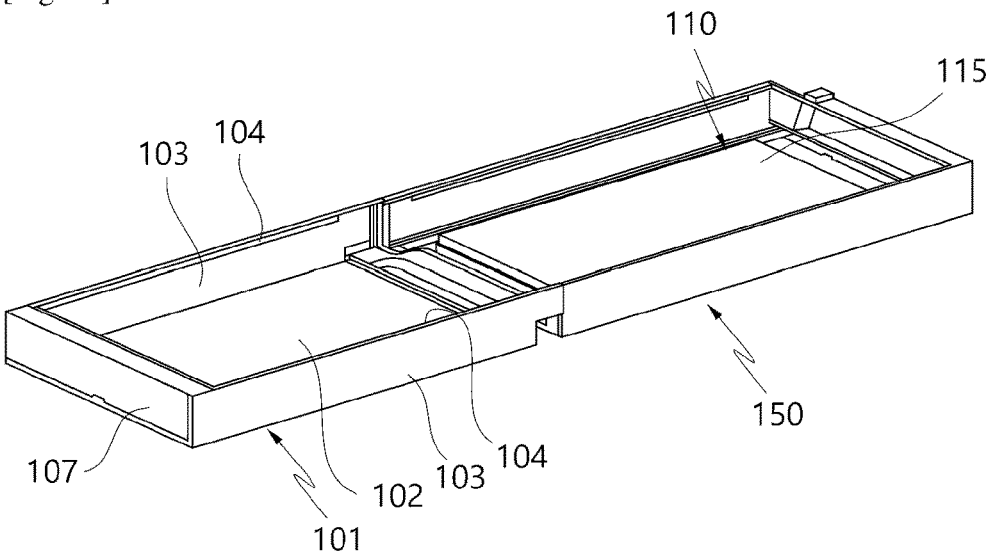
[Fig. 21]
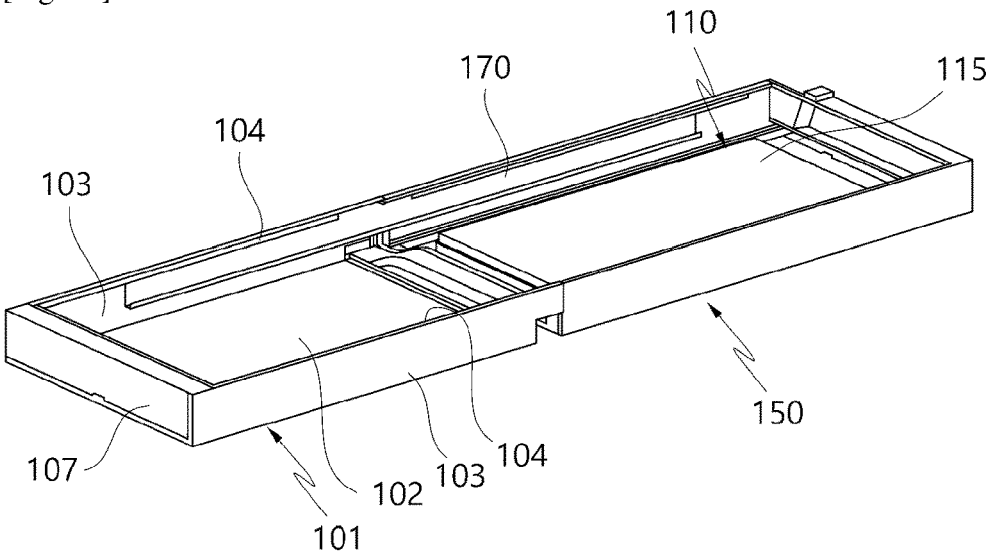
[Fig. 22]
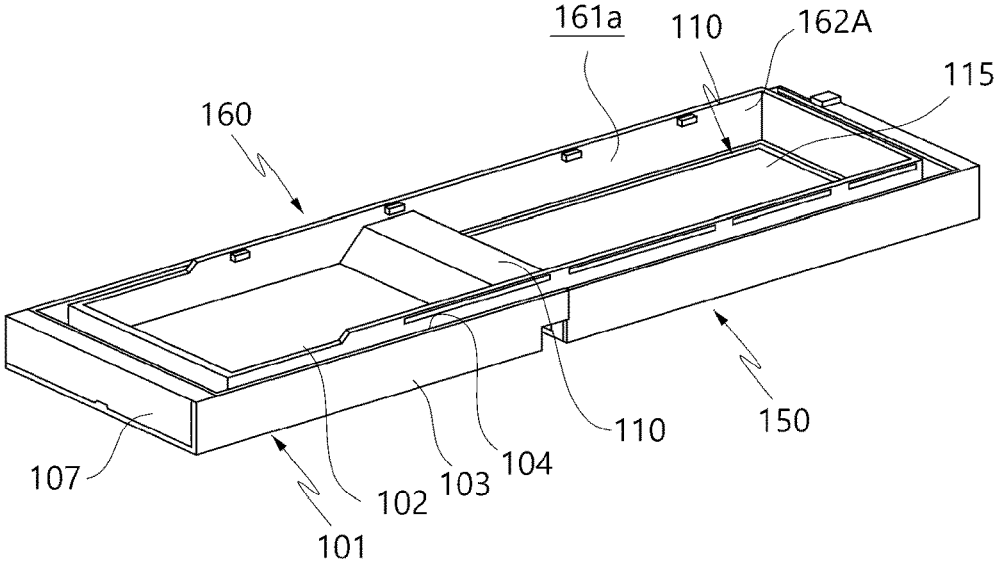

REFRIGERATOR

CROSS-REFERENCE TO RELATED APPLICATIONS

This application is a National Phase application under 35 U.S.C. § 371 of International Application No. PCT/KR2022/006630, filed on May 10, 2022, which claims the benefit of Korean Application No. 10-2021-0092997, filed on Jul. 15, 2021. The contents of the aforementioned applications are hereby incorporated by reference in their entirety.

TECHNICAL FIELD

The present disclosure relates to a refrigerator.

BACKGROUND ART

Recently, a refrigerator has been proposed in which even without a user opening a door of a refrigerator, the inside of the refrigerator can be seen to reduce the number of times of opening and closing the door of the refrigerator and to prevent the loss of cold air due to the frequent opening and closing of the door. Such a refrigerator door may generally include a panel assembly made of glass through which the inside of the refrigerator can be seen, and a door frame supporting the panel assembly.

The door frame may be made of only a metal material or may be made to include synthetic resin, and parts thereof may be fastened to each other by screws. However, recently, in order to enhance the beauty of the refrigerator, the door frame is often made of metal. When the door frame is made of metal, a structure for fixing the panel assembly (glass) is difficult to be embodied on the door frame.

To solve this problem, a trim part for fixing the panel assembly may be provided separately from the door frame made of metal. However, when the trim part separate from the door frame made of metal is provided, the uniformity of the exterior of the door and the beauty thereof deteriorate.

Particularly, the panel assembly which is heavy is coupled to the trim part, so the coupling force of the door frame to the trim part is also required to be high. When the assembly structure of the door frame is made by extruding a metal material in order to obtain the high coupling force, the manufacturing cost of the door increases, and when the complex assembly structure of the door frame is made by bending a metal material multiple times, manufacturing errors thereof are more likely to occur, so the quality of the door degrades.

In Korean Patent Application Publication No. 10-2013-0044134, a technology is disclosed in which a side frame made of synthetic resin supports a tempered glass panel. Since the side frame is made of synthetic resin, the side frame is lighter and is easier to embody a complex shape, compared to a side frame made of metal, but is not harmonious with a main body of a refrigerator made of metal.

In Korean Patent Application Publication No. 10-2021-0071914, a technology is disclosed in which separately from a metal chassis, a side trim which is an injection molding product is provided to fix a panel. However, according to the prior technology, a structure to couple the metal chassis to the injection molding product is complex, and the metal chassis is required to be made by extruding a metal material, so the manufacturing of the door is difficult, and the manufacturing costs thereof is high. Additionally, it is difficult that the coupling portion of the chassis to the side trim stably supports the panel which is made of glass and heavy.

Documents of Related Art (Patent Document 1) Korean Patent Application Publication No. 10-2013-0044134

(Patent Document 2) Korean Patent Application Publication No. 10-2021-0071914

DISCLOSURE OF INVENTION

Technical Problem

Accordingly, the present disclosure has been made keeping in mind the above problems occurring in the related art, and the present disclosure is intended to propose a refrigerator in which a frame (an outer side body) of a door is made of a metal material, and a structure for fixing a front panel is embodied by a separate part (an inner side body).

In addition, the present disclosure is intended to propose a refrigerator in which the coupling structure of the outer side body is bent such that the outer side body is coupled to the inner side body.

Furthermore, the present disclosure is intended to propose a refrigerator in which each of the inner side body and the outer side body provides a unified beauty.

Solution to Problem

In order to achieve the above objectives, according to one aspect of the present disclosure, a refrigerator of the present disclosure may include: a cabinet in which a storage compartment is formed, and a door configured to open and close the storage compartment. The door may be provided with a panel assembly in which a front panel constituting the front surface of the door and a rear panel laminated on a rear of the front panel are connected to each other. The door may include a side frame constituting each of the opposite side surfaces of the door, an upper frame constituting the upper surface of the door, and a lower frame constituting the lower surface of the door. Furthermore, the door may include a door liner in contact with each of the upper frame, the lower frame, the rear panel, and the side frame, and an insulation part formed in a foaming space defined by the panel assembly, the upper frame, the lower frame, the side frame, and the door liner.

In this case, the side frame may include an inner side body coupled to the rear surface of the front panel, and an outer side body connected to the inner side body and constituting each of the opposite side surfaces of the door. Accordingly, a complex structure to securely fix the panel assembly may be easily embodied by the inner side body which is injection-molded, so in spite of the exterior of the refrigerator door being made of metal, the manufacturing of the refrigerator door may be facilitated.

In addition, the inner side body may be provided with a side coupling part spaced apart from the rear surface of the front panel, and the outer side body may be provided with a first side bent part in surface contact with the side coupling part, wherein the side coupling part and the first side bent part may be coupled to each other by a fastener. Accordingly, the inner side body and the outer side body may be securely fastened to each other and may stably support the panel assembly.

Furthermore, a partitioning wall may protrude on an end of the side coupling part, and a second side bent part in surface contact with the partitioning wall may be connected to the first side bent part. Accordingly, the inner side body and the outer side body constituting the side frame may have at least two contact surfaces different from each other, and the multiple contact surfaces may increase coupling sections between associated parts and may reduce the possibility of foaming liquid leaking to the outside.

Additionally, a coupling groove may be formed in the partitioning wall by being recessed therefrom, and an end of the second side bent part may be inserted into the coupling groove. When the second side bent part is fitted into the coupling groove, the inner side body and the outer side body may maintain a state temporarily assembled with each other prior to injecting foaming liquid, and accordingly, the manufacturing of a refrigerator door may be facilitated.

In addition, the coupling groove may be open toward the rear surface of the front panel, and the second side bent part may bend orthogonally from the first side bent part and may extend in parallel to a base of the outer side body.

Furthermore, the inner side body may be provided with an outer casing part extending toward a peripheral surface of the front panel, and the surface of the outer casing part and the surface of the outer side body may constitute the same plane. Accordingly, the unified beauty of the refrigerator may be embodied.

Additionally, an end part of the outer casing part may cover a portion of the peripheral surface of the front panel, and the front surface of the front panel may protrude more forward than the end part of the outer casing part.

In addition, the inner side body may be provided with a panel coupling part coupled to the rear surface of the front panel, and the side coupling part may extend from the panel coupling part. The side coupling part may be spaced apart from the rear surface of the front panel, and may be coupled to the outer side body. Furthermore, the outer casing part may extend toward the peripheral surface of the front panel from an end part of the side coupling part. The outer casing part may constitute a portion of the side surface of the door. In this case, the partitioning wall may be located between the panel coupling part and the side coupling part and may extend toward the foaming space.

Furthermore, the side coupling part and the partitioning wall may be connected orthogonally to each other, and the first side bent part and the second side bent part of the outer side body may be coupled to the side coupling part and the partitioning wall, respectively.

Additionally, a side cover is provided on an end part of the outer casing part by protruding therefrom toward a connection part between a base of the outer side body and a first side bent part. Accordingly, a seam between the inner side body and the outer side body may be covered as much as possible, so the beauty of the refrigerator door may be improved.

In addition, the rear surface of the side coupling part and the coupling end part of the partitioning wall may be spaced apart from each other and thus an insertion path may be formed therebetween. The insertion path may be configured to have a width smaller than the width of the second side bent part of the outer side body.

Furthermore, fastening holes connected to each other may be formed respectively through the side coupling part of the inner side body and the first side bent part of the outer side body, and a rivet may be fastened into the fastening holes.

Additionally, the inner side body may be made of a synthetic resin material, and the outer side body may be made of a metal material.

In addition, the outer side body may include the base constituting the side surface of the door, and the first side bent part bending from the base, wherein the first side bent part may be in surface contact with the side coupling part of the inner side body. The second side bent part may bend from the first side bent part, and may be in surface contact with the partitioning wall of the inner side body.

In addition, in the outer side body, a coupling bent part thereof may be provided at a side opposite to the first side bent part, and the door liner may be connected to the coupling bent part.

Furthermore, the upper frame may include an upper inner body coupled to the rear surface of the front panel, and an upper outer body which connects the upper inner body with the door liner, wherein the upper outer body may constitute the upper surface of the door.

Additionally, the lower frame may include a lower inner body coupled to the rear surface of the front panel, and a lower handle body connecting the lower inner body with the door liner and having a gripping groove formed therein.

In addition, a link frame may be coupled to the edge of the rear panel, and the link frame may be coupled to an end part of the door liner, so the rear panel and the door liner may be connected to each other.

Furthermore, the front surface of the door may include the panel assembly, and a front cover disposed at height different from the height of the panel assembly and connected to the panel assembly. The door may be provided with a reinforcing member which connects the panel assembly with the front cover.

Additionally, the outer side body may be provided on the side surface of the panel assembly and an outer side body may be provided on the side surface of the front cover, and the reinforcing member may be connected to each of the outer side body of the panel assembly and the outer side body of the front cover.

In this case, the reinforcing member may be fastened to the coupling bent part of the outer side body provided at a side opposite to the first side bent part.

Advantageous Effects of Invention

As discussed above, the refrigerator of the present disclosure may have the following effects.

According to the present disclosure, the frame of the refrigerator door may be constituted by the outer side body made of a metal material, and a structure for fixing the panel assembly (glass) may be embodied by the inner side body which is injection-molded. A complex structure to securely fix the panel assembly may be easily embodied by the inner side body which is injection-molded, thereby facilitating the manufacturing of the refrigerator door in spite of the exterior of the refrigerator door made of metal.

In addition, according to the present disclosure, a structure to couple the inner side body to the outer side body may be made on the outer side body through a bending process. That is, even if the outer side body is not manufactured by extrusion, the coupling structure of the outer side body to the inner side body may be embodied, and the outer side body may be manufactured of a material such as steel. Accordingly, the outer frame of the refrigerator and the outer frame of the door may all be made of a unified high-strength material such as steel, thereby embodying the unified beauty of the refrigerator.

Particularly, the inner side body may be made by injecting a synthetic resin material, and thus the coupling structure of the inner side body to the panel assembly (glass) may be made thinner, compared to when the inner side body is made of a metal material. Accordingly, the area of the outer side body made of a metal material exposed to the outside may be increased, thereby improving the beauty of the refrigerator.

Furthermore, according to the present disclosure, the surface of the inner side body and the surface of the outer side body may have the same plane. Accordingly, the refrigerator door may provide a unified beauty, thereby improving the beauty of the refrigerator.

Particularly, the side cover may be provided on the inner side body by protruding therefrom toward the first side bent part of the outer side body, and may cover the bent part of the outer side body. Accordingly, a seam between the inner side body and the outer side body may be covered as much as possible, thereby improving the beauty of the refrigerator door.

In addition, according to the present disclosure, the coupling groove may be formed in the inner side body, and the outer side body may be provided with the second side bent part inserted into the coupling groove. When the second side bent part is inserted into the coupling groove, the inner side body and the outer side body may maintain a state temporarily assembled with each other prior to injecting foaming liquid. Accordingly, the manufacturing of the refrigerator door may be facilitated.

Furthermore, a transparent panel assembly may be applied to the door for the refrigerator, and the inner bodies (trims) supporting the panel assembly may be composed of parts, which are made of synthetic resin materials, assembled with each other by being engaged with each other. Accordingly, compared to the door embodied by only the door frame made of metal, the overall weight of the door may be reduced, thereby decreasing the weight of the assembly of the door.

Particularly, according to the present disclosure, the inner bodies (the inner side body, the upper inner body, and the lower inner body) constituting the door frame may be engaged with each other to be assembled with each other without a fastener such as a screw, and may be supported by the outer side body assembled with the rear of the inner side body. Accordingly, the assembly work of the door may be simplified, and the assemblability thereof may be improved.

Additionally, the inner side body and the outer side body constituting the side frame may have at least two contact surfaces different from each other. The multiple contact surfaces may increase coupling sections between associated parts, and may reduce the possibility of foaming liquid leaking to the outside. Accordingly, the quality of the refrigerator door may be increased.

In addition, according to the present disclosure, the outer side body of the front cover and the outer side body of the side frame which are disposed at heights different from each other may be connected to each other by the reinforcing member. The reinforcing member may be fastened to the outer side bodies made of strong metal materials and may prevent the door from being thermally deformed due to temperature difference between the inside and outside of the refrigerator, thereby improving the durability of the refrigerator door.

BRIEF DESCRIPTION OF DRAWINGS

FIG. 1 is a perspective view illustrating a refrigerator of the present disclosure according to an embodiment.

FIG. 2 is a perspective view illustrating a door constituting the refrigerator of the present disclosure according to the embodiment.

FIG. 3 is an exploded perspective view of parts constituting the door of FIG. 2.

FIG. 4 is a cross-sectional view taken along line IV-IV' of FIG. 2.

FIG. 5 is an enlarged view of an X part of FIG. 4.

FIG. 6 is a cross-sectional view illustrating a sectional structure taken along line IV-IV' of FIG. 2 at an angle different from an angle of FIG. 4.

FIG. 7 is a sectional view taken along line VII-VII' of FIG. 2.

FIG. 8 is a perspective view illustrating a portion of a side frame constituting the door of FIG. 2.

FIG. 9 is a cross-sectional view taken along line IX-IX' of FIG. 8.

FIG. 10 is a perspective view illustrating a pair of side frames constituting the door of FIG. 2.

FIG. 11 is a cross-sectional view taken along line XI-XI' of FIG. 10.

FIG. 12 is a cross-sectional view taken along line XII-XII' of FIG. 10.

FIGS. 13 to 22 are views sequentially illustrating the process of manufacturing the door of FIG. 2.

MODE FOR THE INVENTION

Hereinbelow, an embodiment of the present disclosure will be described in detail with reference to the accompanying drawings. It should be noted that in adding reference numerals to components of each drawing, the same components have the same reference numerals as possible even though they are displayed on different drawings. In addition in describing the embodiment of the present disclosure, when it is determined that detailed descriptions of related well-known structures or functions hinder understanding of the embodiment of the present disclosure, detailed descriptions thereof will be omitted.

In addition, in describing the components of the embodiment of the present disclosure, terms such as first, second, A, B, (a), and (b) may be used. These terms are only for distinguishing the components from other components, and the nature or order of the components is not limited by the terms. When a component is described as being "connected" or "coupled" to another component, the component may be directly connected to or coupled to the another component, but it should be understood that still another component may be "connected" or "coupled" thereto between each component.

An embodiment of a refrigerator of the present disclosure will be described with reference to the accompanying drawings. For reference, the refrigerator provided with a door 100 extending to be vertically long is described below as an example, but the door 100 constituting the refrigerator of the present disclosure may be applied to various home appliances such as a general refrigerator, a wine refrigerator, a kimchi refrigerator, a beverage storage room, a plant cultivation device, and a clothes processing device which have storage space inside.

Referring to FIG. 1, a cabinet 10 may constitute the exterior of the refrigerator and may have an approximately hexahedral shape as illustrated in the drawing. The cabinet 10 may be configured as a casing open forward. The cabinet 10 may include multiple parts, and may largely include an outer casing 11 constituting an outer wall surface thereof.

The open portion of the cabinet 10 may be covered by the door 100 to be described below.

The door 100 may include a left door 100B and a right door 100A. The left door 100B and the right door 100A may function to cover a left storage compartment and a right storage compartment, respectively, in a storage compartment provided in the cabinet 10. The left door 100B and the right door 100A may be opened or closed by rotating in directions different from each other. In the embodiment, the left door 100B and the right door 100A are symmetrical to each other, so description based on the right door 100A will be made below.

Prior to description, the directions of the drawings will be defined. The front side of the refrigerator is a side facing a user when the user looks at the refrigerator from the front side thereof, and the rear of the refrigerator is a side opposite to the front thereof (see the X axial direction of FIG. 1). In addition, the left and right sides of the refrigerator are sides of the left-to-right width direction of the refrigerator (see the Y axial direction of FIG. 1), and the upper and lower sides of the refrigerator are sides of the height direction of the refrigerator (see the Z axial direction of FIG. 1).

FIG. 2 illustrates the door 100 for the refrigerator (hereinafter, referred to as "a door") according to the embodiment. The door 100 may be a structure which is opened and closed by being rotated relative to a hinge (not shown). More precisely, the door 100 may be in close contact with the front surface of the cabinet 10 so as to cover the storage compartment, or may be away from the front surface of the cabinet 10 by being rotated so as to open the storage compartment.

That is, due to the door 100 described above, the refrigerator according to the embodiment of the present disclosure may have an airtight storage compartment. Particularly, the airtight storage compartment described above may store food while maintaining a constant temperature without loss of cold air. In the embodiment, at least a portion of the door 100 may be made as a transparent see-through structure such that the storage compartment can be checked from the outside.

In FIGS. 2 and 3, the detailed structure of the door 100 is illustrated. In the embodiment, a hinge (not shown) may be mounted on one side of the door 100. The hinge may connect the door 100 to the cabinet 10 such that the door 100 is rotatable, and may be assembled with an upper frame B of a door frame A, B, and C to be described below. In the embodiment, the hinge may be installed on the right side of the door 100 relative to FIG. 2, and contrarily, may be installed on the left side of the door 100, and may be installed on a middle part of the door 100 instead of the upper and lower parts thereof. A reference letter H denotes a hinge mounting part to which the hinge is mounted.

Referring to FIG. 2, a transparent panel assembly 110 may be disposed on the front of the door 100, and a door liner 160 may be disposed on the rear of the door 100. The panel assembly 110 may be made of glass, so a user may see the storage compartment through the panel assembly 110. The door liner 160 may constitute the rear surface of the door 100, and may be a part in close contact with the cabinet 10. A basket 163 may be installed on the door liner 160. The basket 163 may be disposed inside the storage compartment when the door 100 is closed.

When the door liner 160 is omitted, a foaming space S (see FIG. 5) which is a rectangular empty space may be open to the rear of the door 100. The foaming space S may be covered by the door liner 160, and in the covered state, foaming liquid may be injected thereto through an inlet and be foamed. The foaming space S may be defined in space surrounded by the panel assembly 110, the door frame A, B, and C, and the rear surface of the door liner 160 to be described below.

In the embodiment, the panel assembly 110 and a front cover 101 may be disposed on the front of the door 100. The panel assembly 110 and the front cover 101 may be disposed at heights different from each other, and the panel assembly 110 may be located above the front cover 101. Alternatively, on the front of the door 100, the panel assembly 110 and the front cover 101 may not disposed separately, but may be configured as one part, or the panel assembly 110 and the front cover 101 may be disposed at left and right sides, respectively.

As described below, after each of the panel assembly 110 and the front cover 101 has an independent assembly process, the panel assembly 110 and the front cover 101 may be connected to each other by a reinforcing member 170. The detailed coupling structure of the panel assembly 110 and the front cover 101 to each other will be described again below.

Referring to FIG. 3, parts constituting the door 100 are illustrated in an exploded state. First, as for the structure of the front cover 101, the front cover 101 may not be provided with glass parts, and may be a structure through which the storage compartment cannot be seen. The front cover 101 may be provided with a front plate 102, an outer side body 103, and a connection body 105. The front plate 102, the outer side body 103, and the connection body 105 may be made by bending a single metal material, for example, a steel material.

Referring to 18, the lower plate 107 may be coupled to the bottom of the front cover 101, and a connection plate 109 may be assembled with the upper part of the front cover 101. The connection plate 109 may be recessed backwards to form space for a user to put a hand in. Additionally, the connection plate 109 may be a part connected to the lower handle body 200 of a lower frame C to be described below.

In addition, the front cover 101 may be provided with a side surface bent part 104, and the reinforcing member 170 to be described later may be fastened to the side surface bent part 104. The reinforcing member 170 may be fastened to each of the side surface bent part 104 and the coupling bent part 155 of the outer side body 150, and may connect the two outer side bodies 103 and 150 to each other.

Referring back to FIG. 3, from the front of the door 100 to the rear thereof, the panel assembly 110, the door frame A, B, and C, a heater housing 180, a link frame 190, and the door liner 160 are illustrated. Among these parts, the heater housing 180 may be regarded to be disposed between a rear panel 115 of the panel assembly 110 and the door frame A, B, and C. Among these parts, the door frame A, B, and C, the heater housing 180, and the link frame 190 are parts assembled with the panel assembly 110, and the door liner 160 may be regarded as a part connected to both the panel assembly 110 and the front cover 101.

Here, the panel assembly 110 may constitute the front surface of the door 100 and may be a part through which the storage compartment can be seen. The door frame A, B, and C may be a part covering the peripheral surface of the panel assembly 110, and the heater housing 180 may be a part which prevents condensation of the panel assembly 110, and the link frame 190 may be a part which connects the door frame A, B, and C with the door liner 160.

First, when looking at the panel assembly 110, the panel assembly 110 may be composed of multiple layers of glass panels. More precisely, the panel assembly 110 may have a plurality of transparent panels laminated on each other by being spaced apart from each other, and the inside of the refrigerator may be selectively seen through the panel assembly 110. In the embodiment, the panel assembly 110 may have a plurality of glass panels disposed by being spaced apart from each other to form an insulation layer, but is not necessarily limited to glass, and may be made of various transparent materials.

In addition, among the polarity of panel layers, the front panel 111 constituting the front surface of the panel assembly 110 may be made of a half glass material such that the inside of the refrigerator can be selectively seen, or may be made to be translucent by applying a film on the front panel.

Referring to FIG. 4, the panel assembly 110 may be composed of the front panel 111 constituting the front surface of the panel assembly 110, and the rear panel 115 laminated on the rear surface of the front panel 111. The rear panel 115 may be laminated on the rear of the front panel 111, and in the embodiment, the rear panel 115 may include two layers, but may include one layer or less, or at least three layers. In the embodiment, the panel assembly 110 may be configured as three layers of glass including the front panel 111 and the rear panel 115.

Such a panel assembly 110 may be made of glass or a material through which the inside can be seen, and may be configured such that the inside of the refrigerator can be selectively seen. Furthermore, each of the front panel 111 and the rear panel 115 may be made of an insulating material or may have an insulating structure, and may be configured such that cold air inside the refrigerator does not leak out.

Meanwhile, the rear panel 115 may have a size smaller than the size of the front panel 111. More precisely, the area of the front panel 111 may be greater than the area of the rear panel 115. Accordingly, the edge of the front panel 111 may protrude more than the edge of the rear panel 115, that is, the side surface of the rear panel 115.

Accordingly, the more protruding part of the front panel 111 may be called a bezel part, and a part inside the bezel part may be called a see-through part. The see-through part may be a transparent part of the panel assembly 110 through which the inside of storage space can be seen, and the bezel part is not required to be transparent. In the embodiment, the bezel part may be present only in the front panel 111, but the see-through part may be present in both the front panel 111 and the rear panel 115.

A gap maintaining rod 118 may be inserted between each glass constituting the panel assembly 110. The gap maintaining rod 118 may maintain a gap between each glass, and each glass and a plurality of gap maintaining rods 118 may be attached to each other by adhesive, and sealant may be applied in the gap to maintain an airtight state between the front panel 111 and the rear panel 115.

A low-emission coating layer may be formed on the rear surface of the rear panel 115 so as to reduce heat transfer into the storage compartment due to radiation. Glass having the low-emission coating layer formed thereon is referred to as low-E glass, and generally, the low-emission coating layer may be formed on the surface of glass by depositing, for example, sputtering. Furthermore, the sealed space between the front panel 111 and the rear panel 115 defined by the gap maintaining rod 118 may be in a vacuum state to be insulated.

As required, the sealed space between the front panel 111 and the rear panel 115 may be filled with an inert gas such as argon gas for insulation. Inert gas has more excellent insulation properties than general air.

Next, the door frame A, B, and C will be described. The door frame A, B, and C may be configured by assembling individual frames with each other. That is, when the individual frames constituting the four sides of the door frame A, B, and C are assembled with each other by being engaged with each other, the door frame A, B, and C may be configured. In this case, among the individual frames, multiple inlets (not shown) connected to the foaming space S may be formed in the upper frame B or the lower frame C, and each of the inlets may be open in the height direction of the door frame A, B, and C. In the embodiment, the inlet may be formed in the upper frame B.

In the embodiment, the door frame A, B, and C may include a pair of side frames A, the upper frame B, and the lower frame C. In this case, each of the pair of side frames A, the upper frame B, and the lower frame C may include two parts. A portion of parts of such a door frame A, B, and C may be bonded to the front panel 111 so as to support the front panel 111, and a remaining portion thereof may be connected to the door liner 160 so as to be an outer part defining the foaming space S.

Referring to FIGS. 3 to 6, the side frame A will be described. The side frame A may be bonded to the front panel 111 and, at the same time, may constitute the side surface of the door 100. The side frame A may include an inner side body 120 bonded to the front panel 111 and the outer side body 150 connected to the inner side body 120 and constituting the opposite side surfaces of the door 100.

The inner side body 120 may have the shape of a bar extending long in a vertical direction and may be made by injecting or extruding a synthetic resin material. Accordingly, the inner side body 120 may more easily embody a complex shape by injecting or extruding a synthetic resin material than by bending or extruding a metal material. The inner side body 120 may be assembled with the outer side body 150 so as to constitute one side frame A and may be disposed in front of the outer side body 150.

Referring to FIG. 8, the inner side body 120 and the outer side body 150 may be coupled to each other so as to form an approximately L-shaped structure. The front surface of the inner side body 120 may be a part bonded to the rear surface of the front panel 111, and the side surface of the outer side body 150 may constitute the side surface of the door 100. Referring to FIG. 9, the outer side body 150 may be configured to have a front-to-rear length longer than the left-to-right length of the inner side body 120, and the front-to-rear length of the outer side body 150 may be the side width of the door 100.

Referring to FIG. 10, the pair of side frames A is illustrated. The pair of side frames A is symmetrical to each other, and may have almost the same structures. Difference between the pair of side frames A is that an avoidance part 159 for avoiding a hinge structure is formed on the upper part of one side frame A (a left side frame relative to the drawing).

Referring back to FIGS. 4 and 5, the inner side body 120 may include a panel coupling part 121 coupled to the rear surface of the front panel 111. The panel coupling part 121 may be a part which is bonded to the front panel 111, and in FIG. 5, a reference numeral K denotes an adhesive portion. The rear surface of the front panel 111 and the front surface of the panel coupling part 121 may be bonded to each other by adhesive or a tape. To this end, the panel coupling part 121 is required to have a sufficiently large area.

A side coupling part 122 may extend from the panel coupling part 121. The side coupling part 122 may be spaced apart from the rear surface of the front panel 111, and the panel coupling part 121 and the side coupling part 122 may have a stepped structure therebetween. Accordingly, an empty space may be defined between the side coupling part 122 and the rear surface of the front panel 111. The head part of a rivet R, which is a fastener to be described below, may be positioned in the empty space. In the embodiment, in order to increase coupling strength, the side coupling part 122 may be made to be thicker than the panel coupling part 121.

The side coupling part 122 may be a part coupled to the outer side body 150. An inner side fastening hole 124 may be formed through the side coupling part 122. Referring to FIG. 5, the inner side fastening hole 124 may be connected to an outer side fastening hole 153*a* of the outer side body 150, and the fastener may be inserted into the inner side fastening hole 124 and the outer side fastening hole 153*a* such that the inner side body 120 and the outer side body 150 are coupled to each other.

Referring to FIG. 8, multiple inner side fastening holes 124 may be formed in the inner side body 120 along a longitudinal direction thereof. In the embodiment, the fastener is the rivet R, but the fastener may include bolts/nuts, screws, etc. Alternatively, the side coupling part 122 and the outer side body 150 may be coupled to each other by laser welding without a separate fastener.

An outer casing part 125 may be connected to an end part of the side coupling part 122. The outer casing part 125 may extend orthogonally from the end part of the side coupling part 122 toward the peripheral surface of the front panel 111. The side coupling part 122 may be a part of the inner side body 120 exposed to the outside of the door 100, and may constitute a portion of the side surface of the door 100.

The outer casing part 125, together with the outer side body 150, may constitute the side surface of the door 100. In the embodiment, the outer casing part 125 may constitute a portion of a front part in the side surface of the door 100, and a remaining part of the side surface of the door 100 may be constituted by the outer side body 150. The outer side body 150 may extend up to a position close to the rear surface of the front panel 111, so a major part of the side surface part of the door 100 exposed to the outside may be the outer side body 150.

In the embodiment, the surface of the outer casing part 125 and the surface of the outer side body 150 may constitute the same plane. That is, the surface of the outer casing part 125 and the surface of the outer side body 150 may have the same heights without a step therebetween. Of course, a kind of groove may be formed in the bending portion of the first side bent part 153 to be described below between the surface of the outer casing part 125 and the surface of the outer side body 150, and a side cover 125' may be disposed at this groove.

Specifically, the side cover 125' may be provided on an end part of the outer casing part 125 by protruding therefrom toward the connection part between the base 151 of the outer side body 150 and a first side bent part 153. The side cover 125' may cover the groove formed by bending the first side bent part 153. Accordingly, the surface of the outer casing part 125 and the surface of the outer side body 150 may be made to have an approximately continuous plane.

Referring to FIG. 5, an end part of the outer casing part 125 may cover a portion of the peripheral surface of the front panel 111, and the front surface of the front panel 111 may protrude more forward than the end part of the outer casing part 125. That is, the front panel 111 made of glass may protrude more forward than the outer casing part 125. Accordingly, the portion of the front panel 111 covered by the outer casing part 125 may be reduced, and the portion of the front panel 111 exposed to a user may be increased.

A partitioning wall 126 may protrude between the panel coupling part 121 and the side coupling part 122. The partitioning wall 126 may be located at a boundary part between the panel coupling part 121 and the side coupling part 122 and may extend toward the foaming space S. The partitioning wall 126 may increase the coupling area of the inner side body 120 to the outer side body 150 and may prevent the leakage of foaming liquid, and may provide a structure in which the outer side body 150 and the inner side body 120 can be temporarily assembled with each other.

Referring to FIG. 9, the second side bent part 154 of the outer side body 150 may be connected to the partitioning wall 126. In this case, a coupling end part 127 may be formed on the partitioning wall 126, and may have an approximately U-shaped structure. Accordingly, the coupling groove 126*a* may be formed in the coupling end part 127 by being recessed therefrom. An end of the second side bent part 154 may be inserted into the coupling groove 126*a*. When the end part of the second side bent part 154 is fitted into the coupling groove 126*a*, the outer side body 150 may be temporarily assembled with the inner side body 120.

An end part of the coupling end part 127 and the rear surface of the side coupling part 122 may be spaced apart from each other, and thus the insertion path may be formed therebetween. A reference numeral G denotes the width of the insertion path. The width of the insertion path may be smaller than the width of the second side bent part 154 of the outer side body 150. Accordingly, when the outer side body 150 is moved in a left-to-right direction, the second side bent part 154 may interfere with the coupling end part 127. Accordingly, when assembling the outer side body 150 with the inner side body 120, the outer side body 150 may be rotated in one direction (clockwise relative to FIG. 9), with the end part of the second side bent part 154 fitted into the coupling groove 126*a*, and the outer side body 150 and the inner side body 120 may be temporarily assembled with each other.

In FIG. 9, a reference numeral 121*a* denotes a reinforcing rib connecting the partitioning wall 126 with the panel coupling part 121. Furthermore, a reference numeral 123 denotes a corrugated part formed on the front surface of the side coupling part 122. As illustrated in FIG. 8, the corrugated part 123 may extend long along the longitudinal direction of the inner side body 120. The corrugated part 123 may function to reinforce the rigidity of the inner side body 120 and to reduce the overall weight of the inner side body 120.

Referring to FIG. 10, a frame coupling hole 129 may be formed in each of the upper and lower parts of the panel coupling part 121. The frame coupling hole 129 may be a hole formed through the panel coupling part 121, and a coupling hook (not shown) of each of the upper frame B and the lower frame C may be held in the frame coupling hole 129. When the coupling hook is held in the frame coupling hole 129, the side frame A may be connected to the upper frame B and the lower frame C.

For convenience of explanation, prior to the upper frame B and the lower frame C, the outer side body 150 will be described first. The outer side body 150 may be a part constituting the side surface of the door 100 to make the frame of the door 100. In the embodiment, the outer side body 150 may be made of a metal material, and may be made of steel like the frame of the cabinet 10. Accordingly, in the embodiment, the frame of the door 100 may be constituted by the outer side body 150 made of a metal material, and a structure for fixing the panel assembly 110 may be embodied by the inner side body 120 which is injection-molded. A complex structure to securely fix the panel assembly 110 may be relatively easily embodied by the inner side body 120 which is injection-molded.

The outer side body 150 may be made by bending a metal material. Specifically, the outer side body 150 may be provided with the base 151 constituting the side surface of the door 100. The base 151 may extend on one direction to be flat plate, and may constitute the side surface of the door 100. Furthermore, the first side bent part 153 and the coupling bent part 155 may be provided respectively on the opposite ends of the base 151. Both the first side bent part 153 and the coupling bent part 155 may be parts bent from the base 151.

The first side bent part 153 may be bent at the base 151, and may be in surface contact with the rear surface of the side coupling part 122 of the inner side body 120. A part bent at the first side bent part 153 may be the second side bent part 154. The second side bent part 154 may be in surface contact with the partitioning wall 126 of the inner side body 120. That is, the first side bent part 153 and the second side bent part 154 may extend orthogonally to each other and may be in surface contact with the side coupling part 122 and the partitioning wall 126, respectively.

Accordingly, the outer side body 150 may be in surface contact with at least two different surfaces of the inner side body 120, and thus foaming liquid may be prevented from leaking to the outside through a position between the outer side body 150 and the inner side body 120. Of course, the assembly of the outer side body 150 with the inner side body 120 may be more stably performed As illustrated in FIG. 5, the outer side fastening hole 153*a* may be formed through the first side bent part 153. The outer side fastening hole 153*a* may be connected to the inner side fastening hole 124, and the rivet R may pass through the outer side fastening hole 153*a* and the inner side fastening hole 124. The rivet R may fasten the first side bent part 153 to the side coupling part 122.

The coupling bent part 155 may be provided at a side opposite to the first side bent part 153. A reinforcing end part 156 may be connected to the coupling bent part 155, and the coupling bent part 155 and the reinforcing end part 156, together with the base 151, may make an approximately "U" shape. Accordingly, the coupling bent part 155 may face the first side bent part 153, and the reinforcing end part 156 may extend in parallel to the second side bent part 154. The reinforcing member 170 to be described below may be coupled to the reinforcing end part 156. FIG. 9 illustrates a portion of a reinforcing body 171 of the reinforcing member 170.

Referring to FIGS. 4 and 6, the door liner 160 may be coupled to the coupling bent part 155. A coupling body 165 of the door liner 160 may be connected to the coupling bent part 155. The coupling bent part 155 and the coupling body 165 of the door liner 160 may be connected to each other and may cover the foaming space S.

Next, referring to the upper frame B, the upper frame B may include an upper inner body 130 and an upper outer body 135. The upper inner body 130 may be disposed in front of the upper outer body 135 and may be bonded to the front panel 111, and the upper outer body 135 may be disposed behind the upper inner body 130 and may be connected to the door liner 160.

Referring to FIG. 7, the upper inner body 130 may be coupled to the rear surface of the front panel 111, and may cover a portion of the edge of the upper end of the front panel 111. A portion of the upper surface of the upper inner body 130 may be exposed to the outside, but a remaining portion thereof may be present in the foaming space S so as not to be exposed to the outside.

The upper inner body 130 may be provided with a fastening protrusion part 132. The fastening protrusion part 132 may be fitted into a fastening groove part 139*a* of the upper outer body 135, and thus the upper inner body 130 and the upper outer body 135 may be assembled with each other. Furthermore, a seating end 134 may protrude on the upper inner body 130. The seating end 134 may protrude into the foaming space S and a seating leg 139 of the upper outer body 135 may be seated on the seating end 134. A reference numeral K2 denotes a contact surface between the upper inner body 130 and the rear surface of the front panel 111.

The upper outer body 135 may connect the upper inner body 130 with the door liner 160, and may constitute the upper surface of the door 100. The upper outer body 135 may be provided with an upper link part 136 so as to be coupled to the door liner 160. The upper link part 136 may extend in parallel to the front panel 111.

The upper outer body 135 may be provided with a harness mounting part 137. The harness mounting part 137 may have a structure depressed toward the foaming space S, and electrical components for controlling the door 100 may be installed in the harness mounting part 137. For example, a sensor may be mounted to the harness mounting part 137. A connector housing (not shown) or a board module may be disposed in the harness mounting part 137.

After an electric wire passes through a harness hole 137*a* located at the lower part of the harness mounting part 137, the harness hole may be sealed by a tape. After an insulation part is formed in the foaming space S, an opening part 138*a* located at the upper part of the harness mounting part 137 may be covered by the cover 138. FIG. 2 illustrates the cover 138 coupled to the opening part 138*a*.

Next, looking at the lower frame C, the lower frame C may include a lower inner body 140 and the lower handle body 200. The lower inner body 140 may be a part bonded to the lower part of the rear surface of the front panel 111 and may be relatively disposed on the front of the door 100. The lower handle body 200 may be coupled to the lower inner body 140, and may connect the lower inner body 140 with the door liner 160. The assembly structure of the lower inner body 140 with the lower handle body 200 may be similar to the assembly structure of the upper inner body 130 with the upper outer body 135, and thus a detailed description thereof will be omitted.

Referring to FIG. 14, a handle part 205 which is a kind of hole may be formed in the lower surface 201 of the lower handle body 200. The handle part 205 is a part held by a user, and a separate part may be coupled thereto. In FIG. 3, a reference numeral 202 denotes an assembly post, and the assembly post 20 may allow the lower handle body 200 to be assembled with a different part, for example, with the side frame A.

The door liner 160 may be coupled to the door frame A, B, and C. The door liner 160 may be assembled with the door frame A, B, and C to cover the foaming space S. More precisely, the foaming space S may be considered as an empty space defined by the rear surface of the front panel 111, the inner side surface of the door frame A, B, and C, the side surface of the rear panel 115, the inner surface of the link frame 190, and the inner surface of the door liner 160.

The door liner 160 may be assembled with the door frame A, B, and C so as to cover the foaming space S, and in this state, when foaming liquid is injected into the foaming space S through the inlet, foaming liquid may be filled in the foaming space S and may be foamed to form the insulation part.

Referring to FIG. 3, a liner body 161 of the door liner 160 may have an approximately rectangular shape, and the liner body 161 may have a center part 161*a* formed therethrough. The door liner 160 may be open in the center part, so the panel assembly 110 may be exposed through the door liner 160 to the storage compartment of the cabinet 10.

An upper body 162A of the door liner 160 may be coupled to the door frame A, B, and C, and a lower body 162B may be assembled with the front cover 101. The upper body 162A and the lower body 162B may be one part connected to each other. That is, the upper body 162A and the lower body 162B may be one part connected to each other and may be considered as an upper and lower body 162.

Referring to FIGS. 4 and 6, the coupling body 165 may be connected to the upper and lower body 162 of the door liner 160. The coupling body 165 may be coupled to the side frame A. More precisely, the coupling body 165 may be coupled to the coupling bent part 155 of the outer side body 150. When the coupling body 165 is coupled to the coupling bent part 155, the foaming space S may be defined in a part at which the coupling body 165 is connected to the coupling bent part 155. A reference numeral 169 denotes a gasket groove into which a gasket (not shown) is fitted.

Meanwhile, the panel assembly 110 and the front cover 101 may be connected to each other by the reinforcing member 170. As illustrated in FIG. 3, the reinforcing member 170 may extend long along the height direction of the door 100. The reinforcing member 170 may be made of a metal material and may function to increase the rigidity of the door 100.

Referring to FIGS. 4 and 6, the reinforcing member 170 may be provided with a plate-shaped reinforcing body 171. An end part of the reinforcing body 171 may be coupled to the reinforcing end part 156 of the outer side body 150 by a fastener such as a bolt. More precisely, a fastening rib 172 provided on one side of the reinforcing body 171 may be coupled to the side surface bent part 104 of the front cover 101 and the reinforcing end part 156 of the outer side body 150. Accordingly, the upper and lower parts of the reinforcing member 170 may be fixed to the two outer side bodies 103 and 150, so the door 100 having a vertical length longer than a horizontal width may be prevented from being thermally deformed due to temperature difference between the inside and outside of the refrigerator. A reference numeral 175 as a reinforcing bent part may be a part bent to have an approximate U shape so as to increase the durability of the reinforcing member 170.

Meanwhile, the heater housing 180 may be located between the rear surface of the front panel 111 and the side surface of the rear panel 115 to be coupled thereto. The heater housing 180 is intended to install a heater (not shown) like a heating wire. In the embodiment, the heater may be installed in a boundary part between the front panel 111 and the rear panel 115 between which the heater housing 180 is located. The heater may prevent condensation which may be formed on the door 100 for the refrigerator. A housing body 181 constituting the heater housing 180 may have an approximately rectangular frame shape, and a first through part 180*a* (see FIG. 3) may be formed in the center portion of the housing body 181 such that the storage compartment can be seen through the panel assembly 110.

Referring to FIG. 6, a heater mounting groove 185 may be formed in the housing body 181 constituting the heater housing 180 such that the heater mounting groove 185 faces the rear surface of the front panel 111. The heater may be mounted in the heater mounting groove 185. The heater mounting groove 185 may be formed at a position adjacent to the rear panel 115.

In addition, an adhesive groove 187 may be formed in the heater housing 180 by being recessed therefrom such that the adhesive groove 187 is adjacent to the heater mounting groove 185. The adhesive groove 187 may be open toward the rear surface of the front panel 111. The adhesive groove 187 may allow adhesive or a tape for fixing the heater housing 180 to the rear surface of the front panel 111 to be more securely held in the heater housing 180. In the embodiment, the adhesive groove 187 may include multiple adhesive grooves and may be a kind of continuous corrugated structure.

The link frame 190 may be coupled to the edge of the rear panel 115. The link frame 190 may be coupled to an end part of the door liner 160, and may connect the rear panel 115 with the door liner 160. As illustrated in FIG. 3, a second through part 190*a* corresponding to the first through part 180*a* may be formed in the center portion of the link frame 190, and thus the storage compartment may be seen through the panel assembly 110.

Referring to FIG. 6, a first connecting end 191 of the link frame 190 may be connected to the rear surface of the rear panel 115, and a second connecting end 192 located at a side opposite to the first connecting end 191 may be connected to a connecting end part 162' of the door liner 160. Accordingly, due to the link frame 190, a gap between the rear panel 115 and the door liner 160 may not be open but be covered. Of course, the link frame 190 may be omitted, and the door liner 160 and the rear panel 115 may be directly connected to each other.

Next, the process of manufacturing the door 100 of the present disclosure will be described with reference to FIGS. 13 to 22. First, as illustrated in FIG. 13, the side frame A may be assembled, and the inner side body 120 and the outer side body 150 constituting the side frame A may be assembled with each other. When assembling the outer side body 150 with the inner side body 120, the outer side body 150 may be rotated in one direction (clockwise relative to FIG. 9), with an end part of the second side bent part 154 fitted into the coupling groove 126*a*, and the outer side body 150 and the inner side body 120 may be temporarily assembled with each other.

Accordingly, when the second side bent part 154 is fitted into the coupling groove 126*a*, the inner side body 120 and the outer side body 150 may maintain a state temporarily assembled with each other prior to injecting foaming liquid. Accordingly, the refrigerator door 100 may be more easily manufactured.

In this state, the upper part of the pair of side frames A may be assembled with the upper frame B, and the lower part thereof may be assembled with the lower frame C. The upper inner body 130 constituting the upper frame B may be disposed relatively at the front side and may be connected to the inner side body 120. Additionally, the upper outer body 135 may be disposed on the upper part of the outer side body 150, and as illustrated in FIG. 7, the fastening protrusion part 132 of the upper inner body 130 may be fitted into the fastening groove part 139*a* of the upper outer body 135, and thus the upper inner body 130 and the upper outer body 135 may be assembled with each other.

In addition, the lower inner body 140 constituting the lower frame C may be disposed relatively at the front side and may be connected to the inner side body 120. Furthermore, the lower handle body 200 may be assembled with the lower inner body 140, and the opposite ends of the lower handle body 200 may be supported by the outer side body 150. This state is illustrated in FIG. 14.

In this case, the assembly of the door frame A, B, and C may be completed. In the embodiment, each inner body (the inner side body 120, the upper inner body, and the lower inner body 140) constituting the door frame A, B, and C may be assembled with each other by being engaged with each other without a fastener such as a screw, and may be supported by the outer side body 150 assembled with the rear of each inner body.

Now, the panel assembly 110 may be bonded to the front surface of the door frame A, B, and C. The front surface of the door frame A, B, and C denotes the front surface of the inner side body 120, the front surface of the upper inner body 130, and the front surface of the lower inner body 140. These front surfaces may constitute the same plane to each other, and may be bonded to the rear surface of the front panel 111. This state is illustrated in FIG. 15.

When the panel assembly is assembled with the door frame, the surface of the inner side body 120 and the surface of the outer side body 150 may constitute the same plane, and the major part of the side surface of the door 100 may be constituted by the outer side body 150, so the beauty of the door 100 may be increased. Particularly, the side cover 125' may be provided on the inner side body 120 by protruding therefrom toward the first side bent part 153 of the outer side body 150, and may cover the bent part of the outer side body, so a seam between the inner side body 120 and the outer side body 150 may be covered as much as possible.

Continuously, when the door frame A, B, and C and the panel assembly 110 are rotated in the direction of an arrow in FIG. 15, the associated parts may be in a state illustrated in FIG. 16. The heater housing 180 may be assembled with the edge of the rear panel 115 of the panel assembly 110 by surrounding the edge of the rear panel 115. The heater housing 180 may be bonded to the rear surface of the front panel 111 close to the peripheral surface of the rear panel 115 by adhesive. In this case, the foaming space S is still open rearward.

Next, the front cover 101 may be assembled. Of course, the front cover 101 may be assembled before the door frame A, B, and C. In FIGS. 17 and 18, the front cover 101 is illustrated. Referring to FIG. 18, the lower plate 107 may be coupled to the bottom of the front cover 101, and the connection plate 109 may be coupled to the upper part of the front cover. The connection plate 109 may be recessed backwards to form space for a user to put a hand in.

Continuously, the assembly of the door frame A, B, and C and the panel assembly 110, which are previously assembled with each other, and the front cover 101 may be assembled with each other. Referring to 19, the assembly of the door frame A, B, and C with the panel assembly 110, and the front cover 101 can be seen to be disposed in a vertical direction. When the assembly of the door frame A, B, and C with the panel assembly 110 and the front cover 101 are coupled to each other, the assembly of the door frame A, B, and C with the panel assembly 110, and the front cover 101 may be in a state illustrated in FIG. 20.

As illustrated in FIG. 21, the reinforcing member 170 may be fastened to the panel assembly 110 and the front cover 101 across the panel assembly 110 and the front cover 101. The reinforcing member 170 may be made of a metal material and may function to increase the rigidity of the door 100. The reinforcing member 170 may be coupled to the reinforcing end part 156 of the outer side body 150 by a fastener such as a bolt. The upper and lower parts of the reinforcing member 170 may be fastened to the panel assembly 110 and the front cover 101, respectively, and the door 100 having a vertical length longer than a horizontal width may be prevented from being thermally deformed due to temperature difference between the inside and outside of the refrigerator.

Continuously, the door liner 160 may be assembled with the rear of each of the panel assembly 110 and the front cover 101. More precisely, first, the link frame 190 may be seated on the rear panel 115, and the door liner 160 may be connected to the link frame 190. In this case, the rear panel 115 and the door liner 160 may be connected to each other by the link frame 190, and the foaming space S may be covered.

Finally, foaming liquid may be filled in the foaming space through the inlet and be foamed to form the insulation part. In this case, the first side bent part 153 and the second side bent part 154 may extend orthogonally to each other and may be in surface contact with the side coupling part 122 and the partitioning wall 126, respectively, and thus the outer side body 150 may be in surface contact with at least two different surfaces of the inner side body 120, so foaming liquid may be prevented from leaking to the outside through a position between the outer side body 150 and the inner side body 120.

The above description is only to illustrate the technical idea of the present disclosure, but those skilled in the art to which the present disclosure pertains will be able to make various modifications and variations without departing from the essential characteristics of the present disclosure. Accordingly, the embodiment disclosed in the present disclosure is not intended to limit the technical spirit of the present disclosure, but to explain it, and the scope of the technical spirit of the present disclosure is not limited to the embodiment. The scope of protection of the present disclosure should be interpreted by the scope of the claims below, and all technical spirits within the scope equivalent thereto should be interpreted as being included in the scope of the claims of the present disclosure.

DESCRIPTION OF THE REFERENCE NUMERALS IN THE DRAWINGS

10: Cabinet 100: Door
101: Front cover 103: Outer side body
110: Panel assembly 111: Front panel
115: Rear panel 120: Inner side body
121: Panel coupling part 122: Side coupling part
126: Partitioning wall **126*a***: Coupling groove
130: Upper inner body 135: Upper outer body
140: Lower inner body 150: Outer side body
151: Base 153: First side bent part
154: Second side bent part 160: Door liner
170: Reinforcing member 180: Heater housing
190: Link frame 200: Lower handle body
A: Side frame B: Upper frame
C: Lower frame S: Foaming space

The invention claimed is:

1. A refrigerator comprising
a cabinet having a storage compartment; and
a door configured to open and close at least a portion of the storage compartment,
wherein the door comprises:
a panel assembly comprising:
a front panel that defines a front surface of the door and is made of a transparent material, a rear panel that defines a rear surface of the door and is made of a transparent material, the rear panel being spaced apart from the front panel, and a gap maintaining rod configured to seal a space defined between the front panel and the rear panel, an outer side body that defines a side surface of the door and is coupled to a rear surface of the front panel, a door liner that defines the rear surface of the door, the door liner having (i) a center portion that defines a quadrangular shaped opening through the door liner and is coupled to the rear panel, and (ii) a gasket groove that is recessed in a direction toward the front panel and extends in a quadrangular shape, an insulation provided by injecting foaming liquid into a foaming space defined by the panel assembly, the outer side body, and the door liner, and a reinforcing member that is configured to prevent the door from deforming and extends from a surface of the gasket groove in the door liner to the direction toward the front panel, wherein the reinforcing member has (i) a first surface, (ii) a second surface that faces the first surface, and (iii) a third surface that connects the first surface and the second surface, and wherein the insulation is in direct contact with the first surface, the second surface, and the third surface of the reinforcing member.

2. The refrigerator of claim 1, wherein the reinforcing member is provided separately from the door liner and coupled between the gasket groove and the outer side body.

3. The refrigerator of claim 1, wherein the reinforcing member is provided separately from the outer side body and coupled between the gasket groove and the outer side body.

4. The refrigerator of claim 1, wherein the first surface, the second surface, and the third surface of the reinforcing member define:

a reinforcing body formed by extending toward the front panel from the surface of the gasket groove and having a plate shape; and a reinforcing bent part extending from the reinforcing body.

5. The refrigerator of claim 4, wherein the reinforcing bent part is bent in a U-shape.

6. The refrigerator of claim 1, wherein the door liner comprises a link frame that is coupled to the center portion of the door liner, and wherein the rear panel is coupled to the door liner in a state in which the link frame is coupled to the door liner.

7. The refrigerator of claim 1, wherein an area of the front panel is greater than an area of the rear panel, and wherein the front panel having a bezel portion that protruding more than an edge of the rear panel.

8. The refrigerator of claim 7, wherein a see-through part is surrounded by the bezel portion of the front panel and configured to allow a user to see the storage compartment through the front panel.

9. The refrigerator of claim 1, wherein an inert gas is filled into the space that is defined by the front panel, the rear panel and the gap maintaining rod.

10. The refrigerator of claim 1, further comprising an upper frame that defines an upper surface of the door, the upper frame comprising:

an upper inner body supporting on the rear surface of the front panel;

an upper outer body extending from the upper inner body and configured to define the upper surface of the door; and an upper link portion extending from the upper outer body and coupled to the door liner.

11. The refrigerator of claim 10, wherein the foaming liquid is injected into the foaming space through an inlet of the upper frame.

12. The refrigerator of claim 11, wherein the upper outer body has a harness mounting portion recessed toward the foaming space, and wherein the refrigerator further comprisesa cover that covers the harness mounting portion.

13. The refrigerator of claim 1, further comprising a basket that is installed on the door liner and arranged inside the storage compartment.

14. The refrigerator of claim 1, wherein the foaming space is defined by the panel assembly, the outer side body, the door liner, an upper frame defining an upper surface of the door, and a lower plate defining a lower surface of the door.

15. The refrigerator of claim 7, wherein the reinforcing member is positioned behind the bezel portion.

16. The refrigerator of claim 1, further comprising an inner side body that is coupled to the outer side body, wherein the inner side body comprises:

a panel coupling portion coupled to the rear surface of the front panel; and a side coupling portion coupled to the outer side body.

17. The refrigerator of claim 1, wherein the rear surface of the front panel is coupled to a front surface of the outer side body by adhesive or a tape.

18. The refrigerator of claim 16, wherein the panel coupling portion and the side coupling portion have a stepped structure, and an empty space is defined between the side coupling portion and the rear surface of the front panel.

19. The refrigerator of claim 8, further comprising:

a heater housing having:

a heater mounting groove defined toward the rear surface of the front panel; and an adhesive groove defined adjacent to the heater mounting groove and open toward the rear surface of the front panel.

* * * * *